US011965708B2

(12) United States Patent
Mebberson

(10) Patent No.: US 11,965,708 B2
(45) Date of Patent: Apr. 23, 2024

(54) ADJUSTABLE GUNSTOCK

(71) Applicant: BESPOKE ENGINEERING PTY LTD, Lonsdale (AU)

(72) Inventor: Nicholas Mebberson, Lonsdale (AU)

(73) Assignee: BESPOKE ENGINEERING PTY LTD., Lonsdale (AU)

( * ) Notice: Subject to any disclaimer, the term of this patent is extended or adjusted under 35 U.S.C. 154(b) by 82 days.

(21) Appl. No.: 17/635,859

(22) PCT Filed: Aug. 14, 2020

(86) PCT No.: PCT/AU2020/050846

§ 371 (c)(1),
(2) Date: Feb. 16, 2022

(87) PCT Pub. No.: WO2021/030860

PCT Pub. Date: Feb. 25, 2021

(65) Prior Publication Data

US 2022/0299293 A1 Sep. 22, 2022

(30) Foreign Application Priority Data

Aug. 19, 2019 (AU) ..... 2019902994

(51) Int. Cl.
*F41C 23/14* (2006.01)

(52) U.S. Cl.
CPC ..... *F41C 23/14* (2013.01)

(58) Field of Classification Search
CPC ..... F41C 23/04; F41C 23/20; F41C 23/14; F41A 11/04
USPC ..... 42/75.03, 73, 71.01
See application file for complete search history.

(56) References Cited

U.S. PATENT DOCUMENTS

| | | | | | |
|---|---|---|---|---|---|
| 1,651,299 | A | * | 11/1927 | Roy, V | F41C 23/14 42/73 |
| 2,100,514 | A | | 11/1937 | Miller et al. | |
| 2,432,519 | A | * | 12/1947 | Garand | F41C 23/14 42/71.01 |
| 3,710,496 | A | | 1/1973 | Packmayr et al. | |
| 4,203,243 | A | * | 5/1980 | Hickman | F41C 23/14 42/73 |

(Continued)

FOREIGN PATENT DOCUMENTS

| | | |
|---|---|---|
| EP | 0950869 | 10/1999 |
| WO | 2014104922 | 7/2014 |
| WO | 2019129645 | 7/2019 |

*Primary Examiner* — Michael D David

(74) *Attorney, Agent, or Firm* — SAND, SEBOLT & WERNOW CO., LPA

(57) ABSTRACT

There is proposed an adjustable gunstock for a firearm, comprising, a base, a mount, at least one relocation member and at least one adjustment member. The base is fixedly connectable to a stock body of the firearm and the mount adjustably engageable with the base. The mount, or a part attachable thereto, forms a shooter's body engaging portion. The at least one relocation member is couplable to the base and configured to adjust the mount relative to the base in a first direction. The at least one adjustment member configured to engage the least one relocation member, and is couplable to the mount, to thereby adjust the mount relative to the base in a second direction, wherein the mount is movable both laterally of, and away from or towards, the stock body of the firearm.

12 Claims, 23 Drawing Sheets

(56) References Cited

U.S. PATENT DOCUMENTS

| | | | | | |
|---|---|---|---|---|---|
| 4,203,244 | A * | 5/1980 | Hickman | F41C 23/14 | 42/73 |
| 4,422,256 | A * | 12/1983 | Maucher | F41C 23/14 | 42/73 |
| 4,589,219 | A * | 5/1986 | Milliman | F41C 23/14 | 42/73 |
| H486 | H * | 7/1988 | Savioli | 42/73 | |
| 5,031,348 | A | 7/1991 | Carey | | |
| 5,235,764 | A | 8/1993 | Perazzi | | |
| 5,392,553 | A | 2/1995 | Carey | | |
| 5,933,997 | A * | 8/1999 | Barrett | F41C 23/14 | 42/73 |
| 6,032,397 | A * | 3/2000 | Iannetta | F41C 23/14 | 42/74 |
| 7,104,002 | B2 * | 9/2006 | Rotundo | F41C 23/14 | 42/71.01 |
| 7,428,794 | B2 * | 9/2008 | Oz | F41C 23/04 | 42/74 |
| 7,640,688 | B2 * | 1/2010 | Oz | F41C 23/14 | 42/72 |
| 7,930,849 | B2 * | 4/2011 | Abraham | F41C 23/14 | 42/73 |
| 7,966,760 | B2 * | 6/2011 | Fitzpatrick | F41C 23/20 | 42/74 |
| 9,823,041 | B2 * | 11/2017 | Forslund | F41C 23/14 | |
| 10,113,831 | B2 * | 10/2018 | Moretti | F41C 23/20 | |
| 10,215,526 | B2 * | 2/2019 | Shinkle | F41C 23/14 | |
| 10,788,287 | B2 * | 9/2020 | Parker | F41C 23/14 | |
| 11,365,952 | B2 * | 6/2022 | Hopkins | F41C 23/14 | |
| 2001/0037597 | A1 | 11/2001 | Beretta | | |
| 2005/0241205 | A1 | 11/2005 | Rotundo | | |
| 2014/0360074 | A1 | 12/2014 | Jarboe | | |

* cited by examiner

ADJUSTABLE GUNSTOCK

FIELD OF THE INVENTION

The present disclosure relates generally to adjustable gunstocks and in one aspect relates to a gunstock having an adjustable comb and an adjustable butt.

BACKGROUND OF THE INVENTION

When using a shoulder type firearm, such as a shotgun or rifle, a user must bring the butt of the gun into the shoulder pocket and place the comb against the face, just underneath the cheek bone. This is done to ensure comfort and enhance accuracy. However, the stocks of most mass-produced guns are designed to fit the average person, which is defined by a manufacturer at the time of production.

Fitting of a gun relates to the process of taking the shooter's physical build and natural attributes into consideration to ensure the muzzle of the gun is in the correct position relative to a target. Gun fit is established by checking a number of elements including, cast, length of pull, drop, comb height, degree of pitch, cast-off and balance. When these elements are correctly taken into consideration, the shooter is more likely to achieve comfort, suitable gun movement control and eye-rib/eye-scope alignment, which leads to gun mounting consistency and accuracy in shooting.

Since correct gun fit is one of the fundamental aspects for the successful use of these types of firearms, some users purchase custom made stock which can be fitted to their firearm. However, over time a person's weight may change, which will affect the fit of the gun. Furthermore, the firearm may be used by a different person, which means it may not correctly fit the new user.

With a scoped rifle, it is desirable to have the head positioned so the eye is looking through the centre of the scope's ocular lens with sufficient eye relief to get a full view of the target area.

Furthermore, the shooting position is also important and will affect the head orientation, for instance, shooting from the prone position will be different compared to shooting from a bench, since it may change the head position on the stock and relationship to the scope. A user will therefore typically set up the firearm for the position it is most likely to be used in and make the appropriate allowances in adapting to shooting in other positions.

To ensure comfort, consistency and accuracy the shooter must mount the gun to the same position each time the gun is mounted. This is true of firearms with open (iron) sights, optical sights and shotguns. The eye must line up with the barrel (or comb on a shotgun) with the eye at a correct height and distance from the sight, telescopic scope or shotgun rib.

Stocks can be 'made to fit' by mechanical changes (by heating and bending) wooden stocks, or by the use of adjustable elements in a stock (such as adjustable combs) or by custom manufacture of a bespoke stock unique to the shooter.

There are a number of guns available on the market and disclosed in the published prior art that include an adjustable stock or part thereof. This means that correct gun fit can be established by adjusting the gunstock to suit the shooter. The adjustments made will depend on the shooter and the particular gun but may include adjustment of the comb, the cast, the stock and/or the butt.

An early patent from 1936, U.S. Pat. No. 2,100,514 to MILLER et al, discloses a sliding cheek piece for gun, however the patent relates to a stock that moves with the recoil of the gun to prevent chafing rather than an adjustable member to provide correct gun-fit.

Another document, U.S. Pat. No. 5,392,553 to CAREY, discloses a shoulder gunstock assembly with a comb piece which is universally adjustable fore and aft, up and down, and laterally. However, CAREY does not permit angling of the comb along the horizontal plane since the "angled bar means" is configured to maintain the longitudinal axis of the comb, such that it is generally parallel with that of the shoulder gun.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

It is therefore an object of a least one of the illustrated embodiments to provide an adjustable gunstock that permits greater adjustment capabilities than currently available gunstocks. Other objects of the illustrated embodiments are to overcome at least some of the aforementioned problems, or at least provide the public with a useful alternative. The foregoing objects should not necessarily be considered as cumulative and various aspects of the invention may fulfil one or more of the above objects.

In one aspect of the invention, but not necessarily the broadest or only aspect there is proposed an adjustable gunstock, comprising:

- a base fixedly connectable to a stock body of a firearm;
- a mount adjustably engageable with the base, the mount, or a part attachable thereto, forming a shooter's body engaging portion;
- at least one relocation member being couplable to the base and configured to adjust the mount relative to the base in a first direction,
- at least one adjustment member configured to engage the least one relocation member, and being couplable to the mount, to thereby adjust the mount relative to
- the base in a second direction,
- wherein the mount is movable both laterally of, and away from or towards, the stock body of the firearm.

The at least one adjustment member may comprise a screw post, that is pivotably couplable to the mount, and the at least one relocation member may comprise a slider block, that is slidably couplable to the base. Alternatively, the adjustment member may comprise a rack and pinion configuration.

Preferably, the adjustable gunstock includes spaced apart first and second adjustment members attached to the mount. Each adjustment member engages a respective relocation member to permit movement of the mount in the first and second directions relative to the base.

The first and second adjustment members may be positioned within the comb and/or butt of the stock body, wherein the shooter's body engaging portion is either a comb portion or a butt portion of the adjustable gunstock. Accordingly, the reader will appreciate that adjustment members can be used to raise or lower the comb, or move the butt backwards or forwards relative to the stock body. Therefore, the term "vertical" and "horizontal" are interchangeable when referring to the operation of the adjustment members, depending upon whether it is being used in conjunction with the comb or the butt.

The adjustable gunstock in one form includes a primary base attached generally horizontally to the stock body, wherein a primary mount engages therewith, and a comb portion is fixedly attached to the primary mount. The immediately preceding form wherein the adjustable gunstock further includes a secondary base attached generally vertically to the stock body, wherein a secondary mount engages therewith, and a butt portion is fixedly attached to the secondary mount.

Preferably, the primary or secondary bases are fixedly connected to the stock body by way of convention screws.

In one form, where the first and second adjustment members are screw post, each screw post engages a top pivot clevis. Each top pivot clevis includes an aperture through which a respective top pivot pin is configured to pass and engage with holes in the mount. In this way, the top pivot clevis is pivotable coupled to the mount, whereby upon rotation of the screw post the mount in moved towards or away from the base.

The screw post is attached to the top pivot clevis, using a screw, which is configured to engage a post internal bushing of the screw post. The reader with therefore appreciate that the screw post can be rotated relative to the top pivot clevis. Each screw post may include a hex head portion that can be engaged by a suitably sized spanner to enable a user to raise or lower the mount to thereby adjust the gun fit.

A relocation member may be associate with each of the first and second adjustment members, and configured to move the mount sideway or laterally relative to the stock body of the firearm. Each relocation member may include a screw member that engages a corresponding slider block. Each slider block is slidable connected to the base, by way of respective slide pin, which permits sideways movement of the slider blocks, under the influence of the screw member. As the reader will appreciate movement or slider blocks control the sideways or lateral movement of the mount relative to the base.

The adjustment and relocation members may utilise Allen key, Phillips or straight screwdriver head portions, or other suitable engagement members.

In another aspect of the invention, there is proposed an adjustable gunstock for a firearm, comprising:

- a base fixedly connectable to a stock body of the firearm;
- a mount adjustably engageable with the base, the mount, or a part attachable thereto, forming a shooter's body engaging portion;
- a first adjustment member including a first rack attachable to and extending outwardly from the mount, a first pinion rotatably attachable to the base and configured to engage the first rack, and a first relocation member configured to move the first rack laterally relative to the first pinion;
- a second adjustment member including a second rack attachable to and extending outwardly from the mount, a second pinion rotatably attachable to the base and configured to engage the second rack, and a second relocation member configured to move the second rack laterally relative to the second pinion; and
- wherein the first adjustment member is movable generally independently of the second adjustment member, such that the mount is movable both laterally of, and away from or towards, the stock body of the firearm.

The base, in one form, may be generally elongate and include a void or voids for retaining a part or parts of the first and second adjustment members, such as but not limited to the first pinion and second pinion. The base includes two passageways for accommodating respective first or second racks. The passageways intersect a respective void or voids, whereby each rack is engageable with a respective pinion retained therein.

In one form the first and second relocation members are socket head cap screws, which is configured the engage a respective cooperatively threaded slidenut. Each slidenut is configured to engage a track in a respective first or second rack. The slidenut permits free movement of the rack along its longitudinal axis, relative to the socket head cap screw, while restraining the lateral movement of the rack, by way of rotation of the socket head cap screw, which thereby moves the slidenut. The first and second pinions are elongate along a longitudinal axis such that a respective rack can be positioned at multiple locations across the face of the respective pinion.

The skilled addressee will appreciate that the configuration of the adjustment members enables the comb or butt of the gunstock to be moved into multiple orientations. For instance, where the adjustment member is being used in conjunction with an adjustable comb portion, the pinion can be rotated to adjust the height of the comb off the gunstock or to control the degree of pitch. The socket head cap screw can be rotated to adjust the position of the rack across the face of the pinion to thereby adjust the lateral position of the comb portion relative to the gunstock or its horizontal angle thereto.

Similarly, where the adjustment member is being used for an adjustable butt portion, rotation of the pinion adjusts the distance to which the butt of the firearm extends rearwardly from the gunstock, for instance to adjust the length of pull, degree of pitch or cast-off. The socket head cap screw can be rotated to adjust the lateral position of the butt portion relative to the gunstock to compensate for the shooter physiological attributes and whether they are right of left handed.

Preferably, each pinion is biased into engagement with a respective lock plate, such that each pinion, or at least one pinion, is inhibited from moving during firing of the gun. The lock plate is used to fix the movable comb or butt to prevent the fit of the gun changing during use.

To move the pinion, to thereby adjust the rack, longitudinal pressure is applied to the pinion against the biasing member such that the pinion disengages from the respective lock plate and it able to be rotated. Once the longitudinal pressure is removed, the pinion moves under the influence of the biasing member back into engagement with the lock plate.

In one form the biasing member is a spring grub screw that engages a sloping face/s on the pinion. The reader should however appreciate that other biasing members, such as a coil or leaf spring, may be used.

Each rack includes a fixable end with a laterally extending hole therethrough, wherein a respective pin is positioned through the hole and is secured to the mount, whereby the rack is connected to the mount, but is pivotable relative thereto. Each rack may still further include two outwardly extending fingers with opposing curved faces that form the track for retaining a slidenut therebetween.

In one form the slidenut in one form has a cylindrical drum shape with a threaded hole extending laterally therethrough, for engaging a socket head cap screw. In this way the slidenut can move longitudinally along the track, while controlling the lateral movement of the rack when the socket head cap screw is rotated.

A secondary biasing member is configured to slidably abut a side of the rack to maintain engagement between helical teeth of the pinion and the gear of the rack. The secondary biasing member may include a spring, such as a helical spring, and a slide for abutment with a side of the rack.

The mount may include an inner mount portion and an outer mount portion, wherein the inner mount portion may be slidably held within or adjoining the outer mount portion, when the adjustment members are positioned within the butt of the stock body. Sliding pins may be connected to the inner mount portion and engage respective sliding tracks within the outer mount portion. A screw member is held by the outer mount portion and is configured to screwably engage the inner mount portion, whereby upon rotation of the screw member the inner mount portion is moved relative to the outer mount portion.

This can be useful when the butt needs to be move vertically relative to the gunstock. It also means that this can be accomplished without interfering with the operation of the adjustable members or relocation members, as discussed above.

In still another aspect of the invention there is proposed a method of fitting a firearm for a shooter, the firearm incorporating the adjustable gunstock in accordance with any one of the above forms, including the steps of:

- rotating or moving at least a part of the adjustment member to thereby adjust a height of the comb off a stock body of the firearm or the distance of the butt from the stock body;
- rotating or moving at least a part of the relocation member to thereby move the comb or butt laterally or sidewardly relative to the stock body;
- whereby the degree of pitch, fit against a face of the shooter, length of pull, cast-off and/or fit against a shoulder of the shooter, are adjusted to provide suitable gun fit for the shooter.

The above method further including the step of moving an inner mount portion relative to an outer mount portion to thereby move the butt vertically relatively to the stock body.

BRIEF DESCRIPTION OF THE DRAWINGS

The accompanying drawings, which are incorporated in and constitute a part of this specification, illustrate an implementation of the invention and, together with the description and claims, serve to explain the advantages and principles of the invention. In the drawings.

DETAILED DESCRIPTION OF THE ILLUSTRATED AND EXEMPLIFIED EMBODIMENTS

Figure 1A:
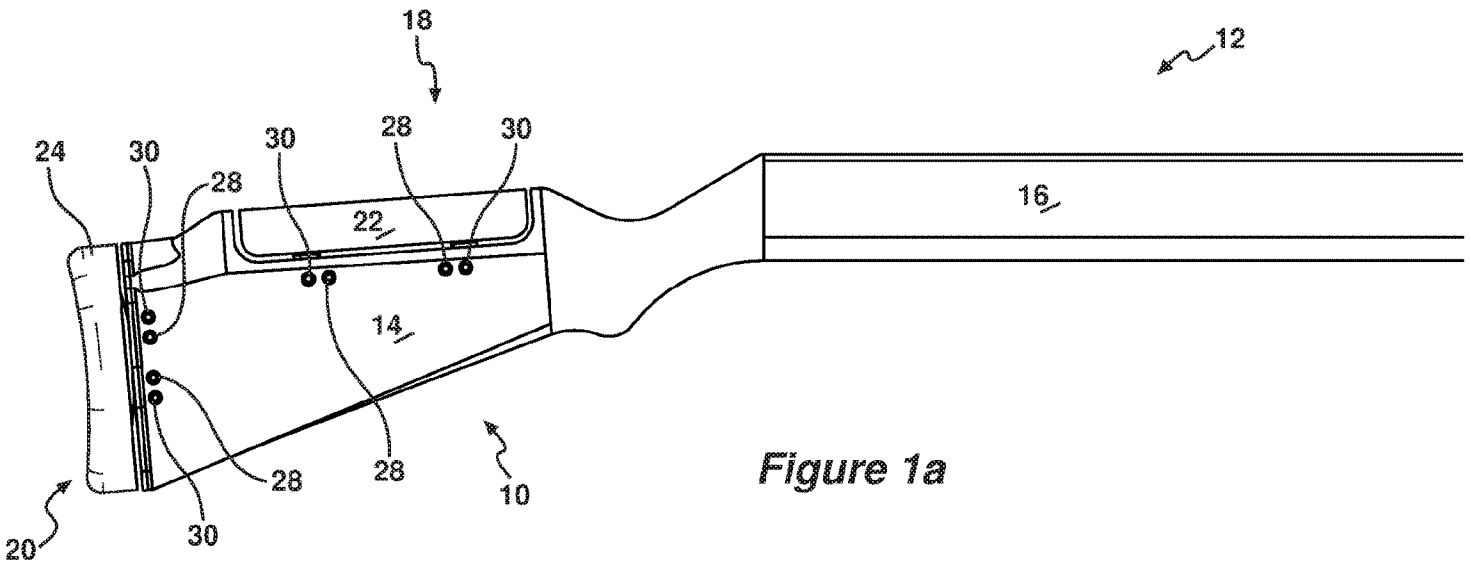
FIG. 1*a* is a side view of a firearm incorporating the adjustable gunstock of the present invention.

Similar reference characters indicate corresponding parts throughout the drawings. Dimensions of certain parts shown in the drawings may have been modified and/or exaggerated for the purposes of clarity or illustration.

Figure 42:
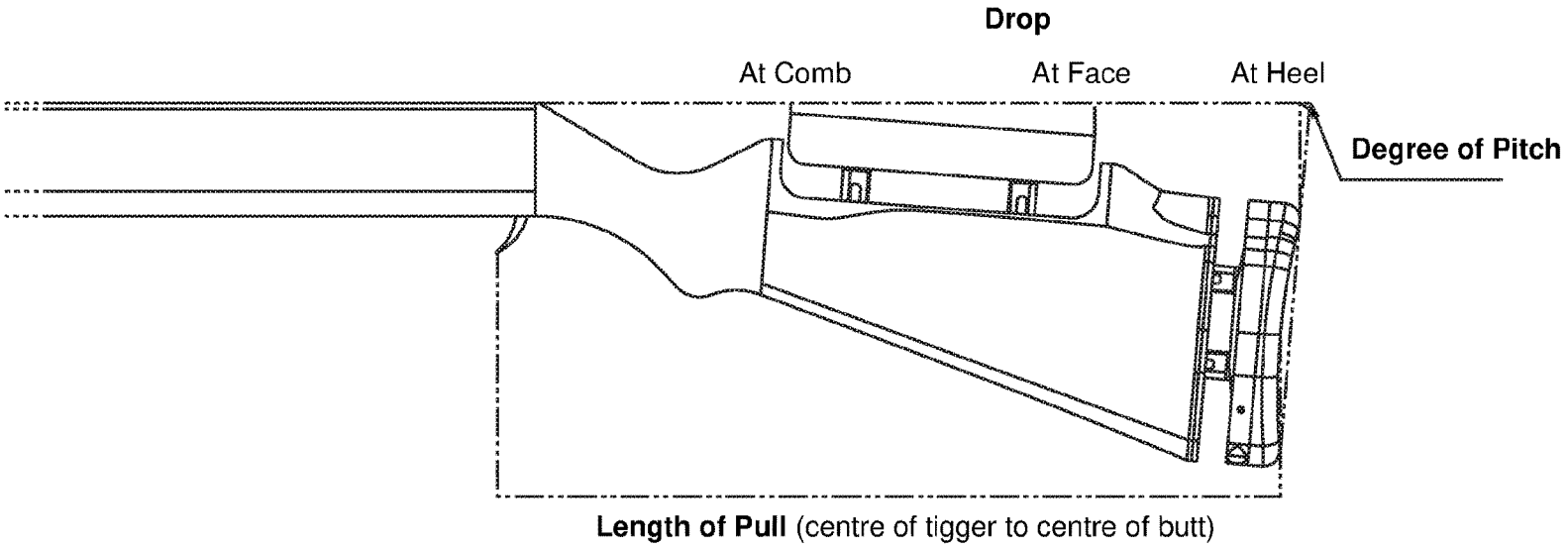
FIG. 42 is a side view providing visual indication of the technical terms used to describe the adjustment.
Figure 43:
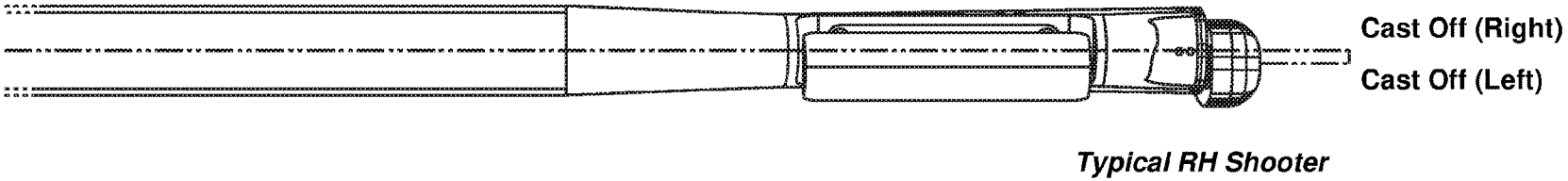
FIG. 43 is another side view providing visual indication of the technical terms.
Figure 44:
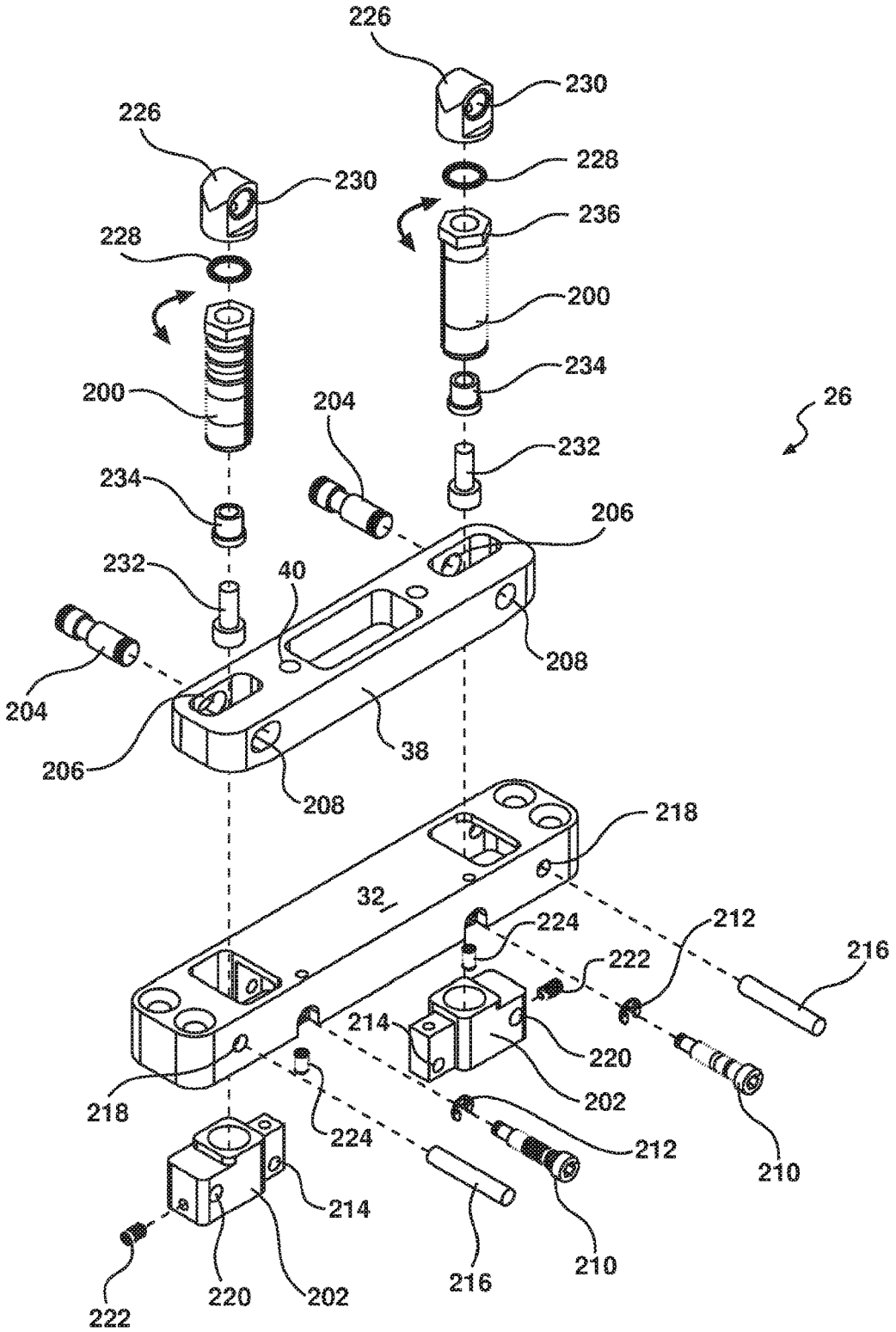
FIG. 44 is an exploded view of another embodiment of the adjustment mechanism of the adjustable gunstock.
Figure 45:
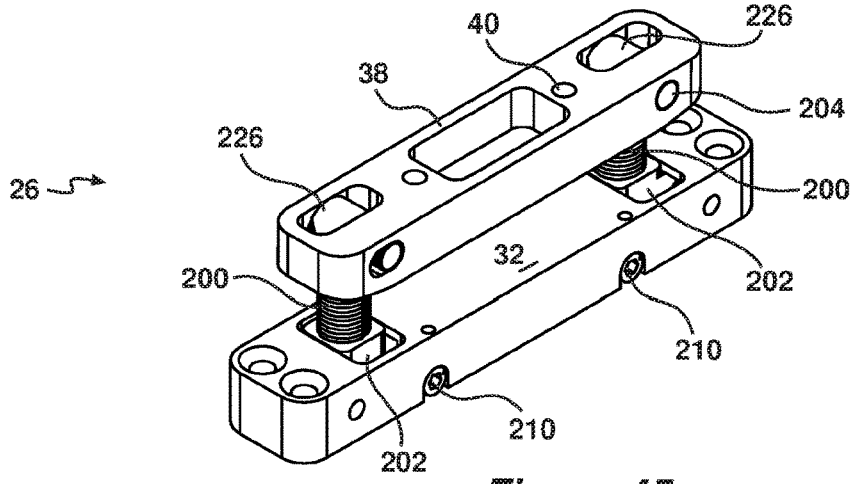
FIG. 45 is a perspective view of the assembled adjustment mechanism of FIG. 44.
Figure 46:
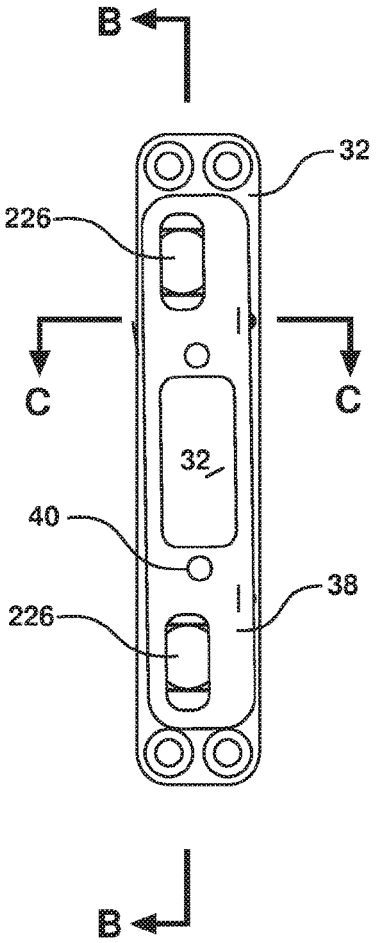
FIG. 46 is a top view of the adjustment mechanism of FIG. 45.
Figure 48:
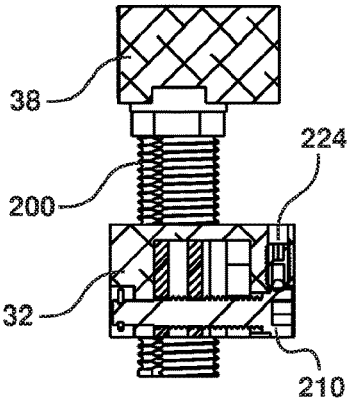
FIG. 48 is a cross-sectional view through C-C of the adjustment mechanism of FIG. 46.
Figure 47:
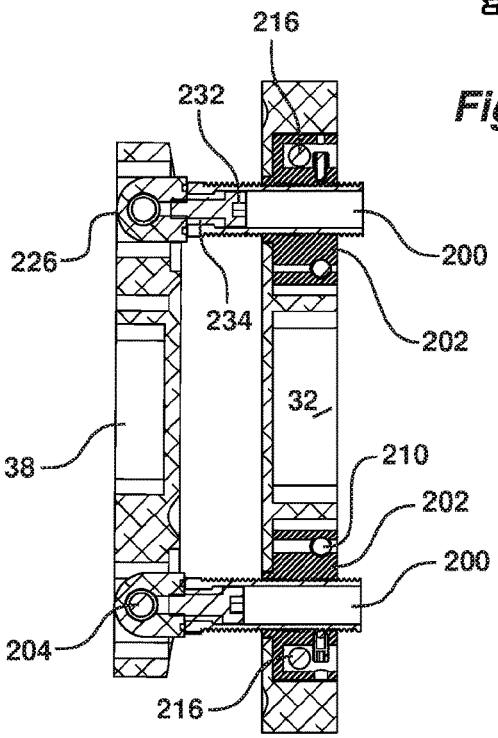
FIG. 47 is a cross-sectional view through B-B of the adjustment mechanism of FIG. 46.
Figure 49:
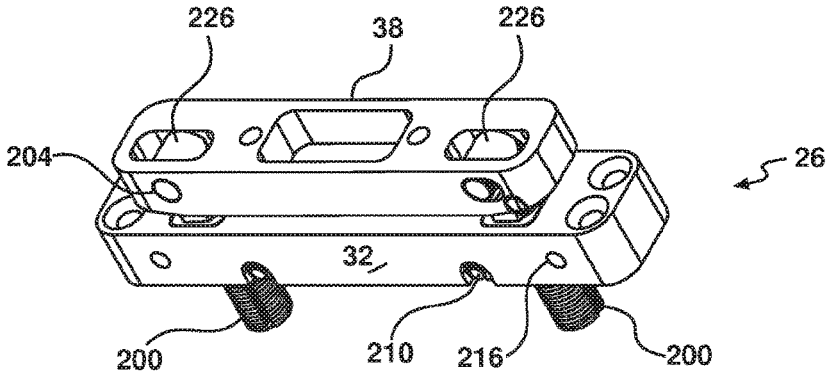
FIG. 49 is a perspective view of the adjustment mechanism in a lowered position.
Figure 50:
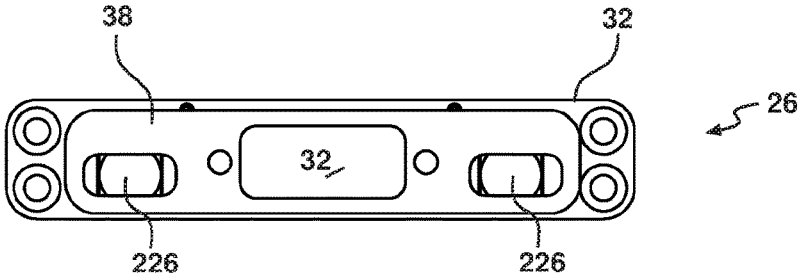
FIG. 50 is a top view of the adjustment mechanism of FIG. 49.
Figure 51:
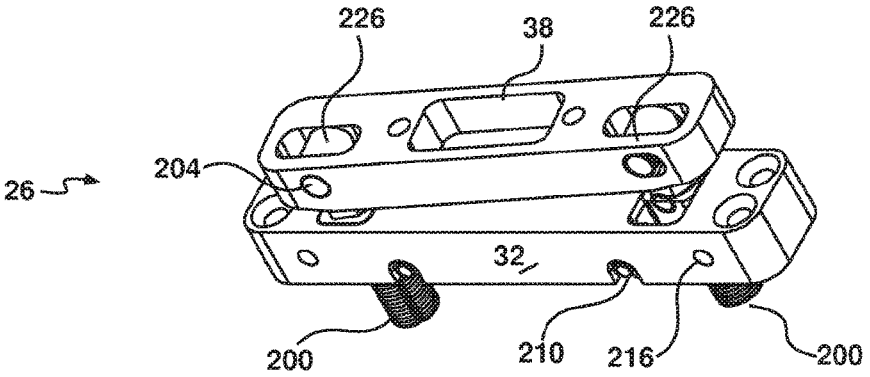
FIG. 51 is a perspective view of the adjustment mechanism illustrating the sideways adjustment of the mount.
Figure 52:
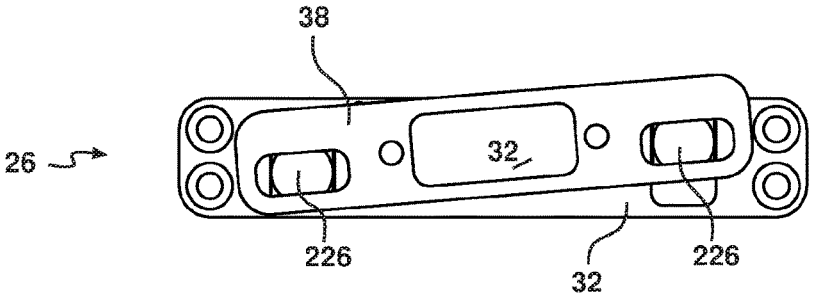
FIG. 52 is a top view of the adjustment mechanism of FIG. 51.
Figure 53:
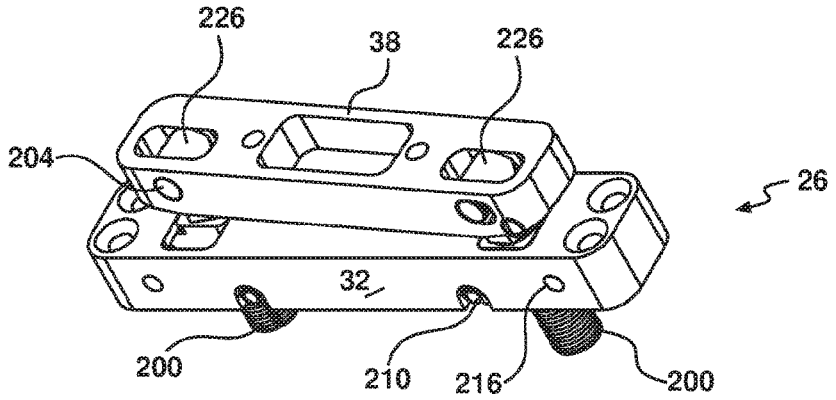
FIG. 53 is a perspective view of the adjustment mechanism illustrating alternate sideways adjustment of the mount.
Figure 54:
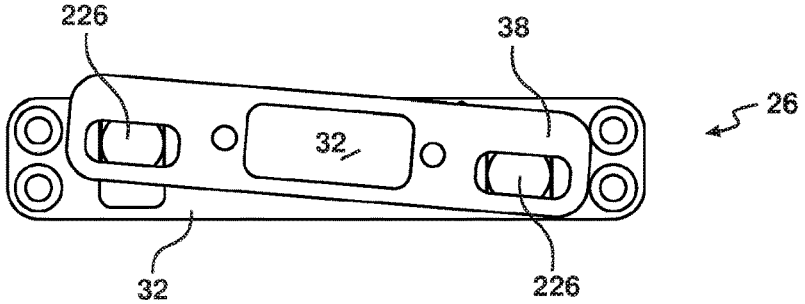
FIG. 54 is a top view of the adjustment mechanism of FIG. 53.
Figure 55:
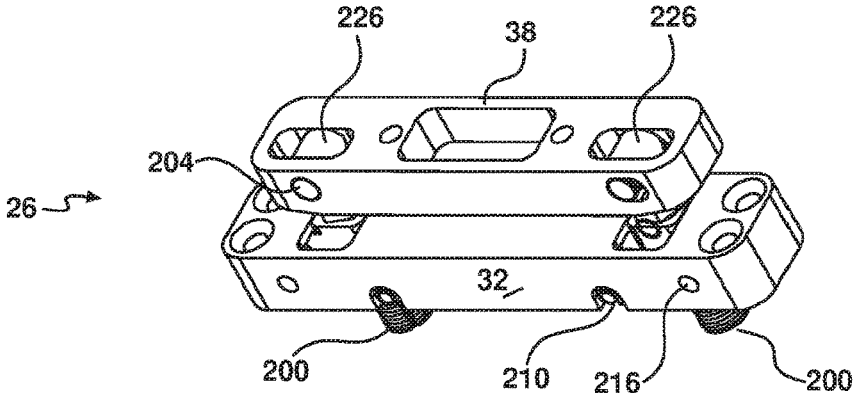
FIG. 55 is a perspective view of the adjustment mechanism illustrating further alternate sideways adjustment of the mount.
Figure 56:
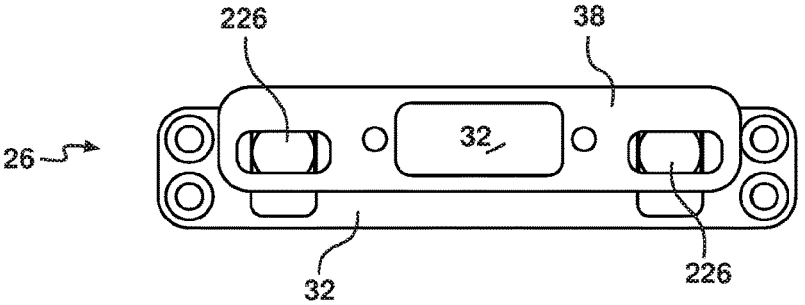
FIG. 56 is a top view of the adjustment mechanism of FIG. 55.
Figure 57:
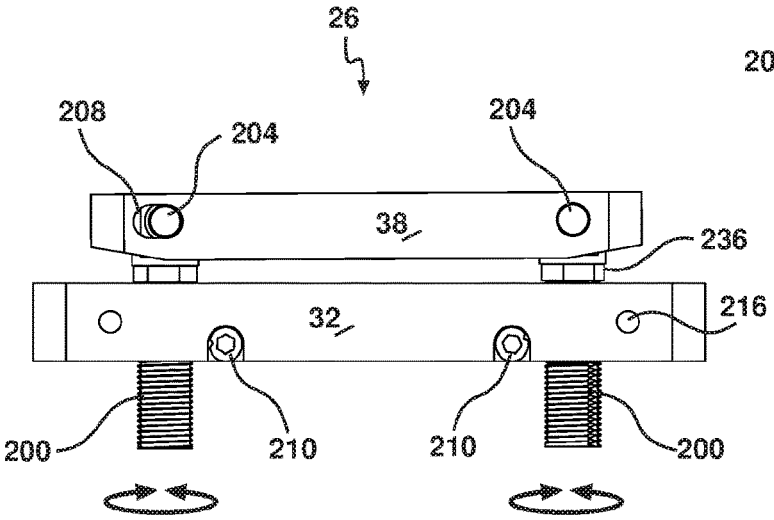
FIG. 57 is a side view of the adjustment mechanism in a lowered position.
Figure 58:
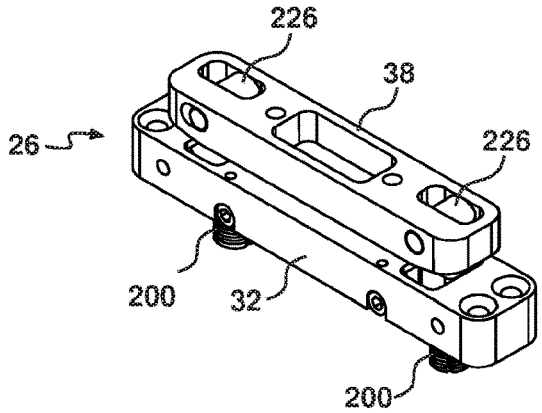
FIG. 58 is a perspective view of the adjustment mechanism of FIG. 57.
Figure 59:
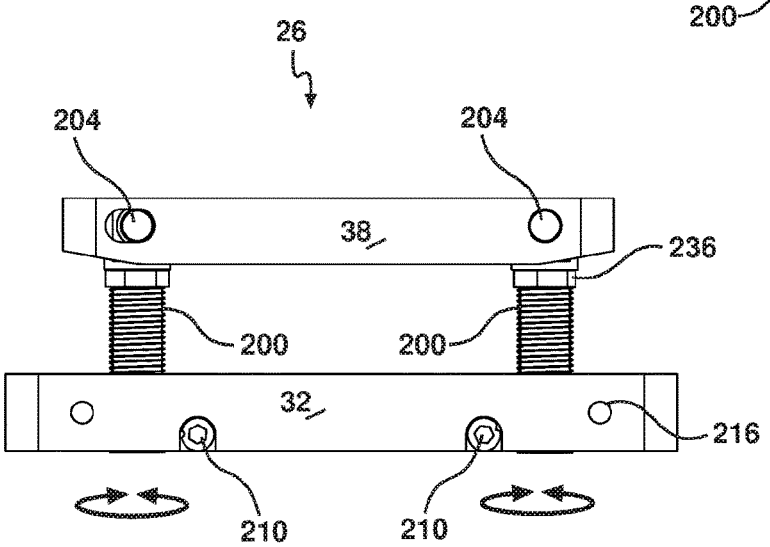
FIG. 59 is a side view of the adjustment mechanism in a raised position.
Figure 60:
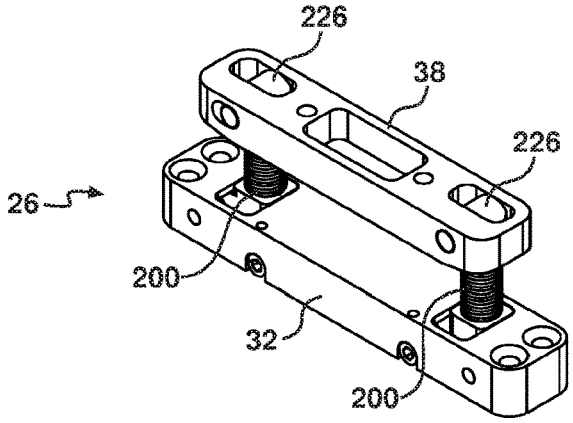
FIG. 60 is a perspective view of the adjustment mechanism of FIG. 59.
Figure 62:
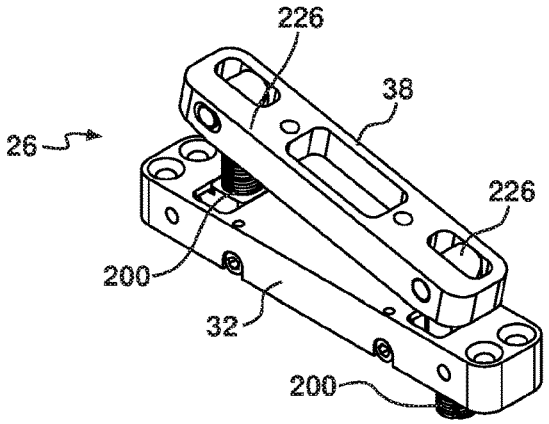
FIG. 62 is a perspective view of the adjustment mechanism of FIG. 61.
Figure 61:
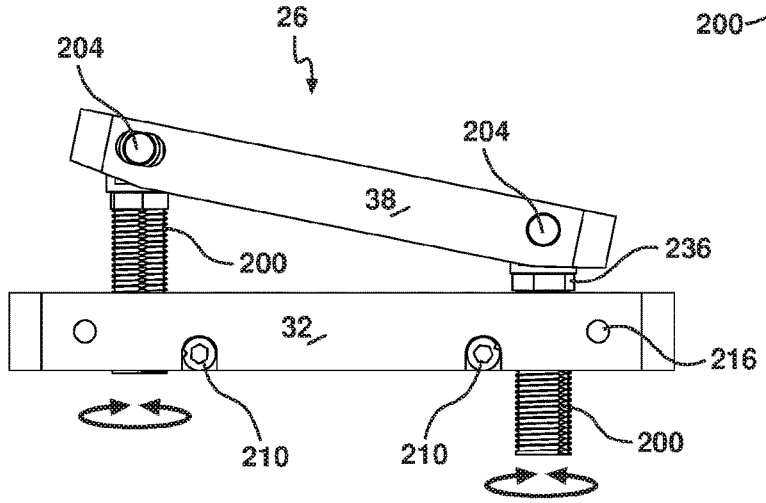
FIG. 61 is a side view of the adjustment mechanism in an angled position.
Figure 64:
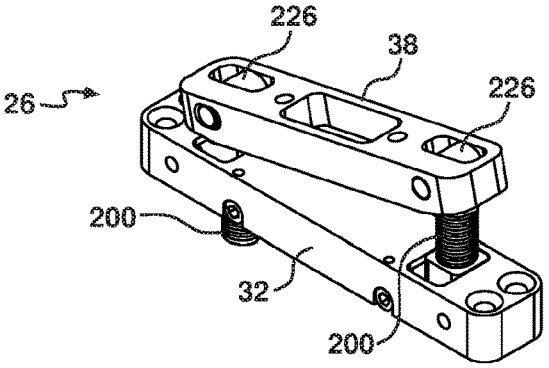
FIG. 64 is a perspective view of the adjustment mechanism of FIG. 61.
Figure 63:
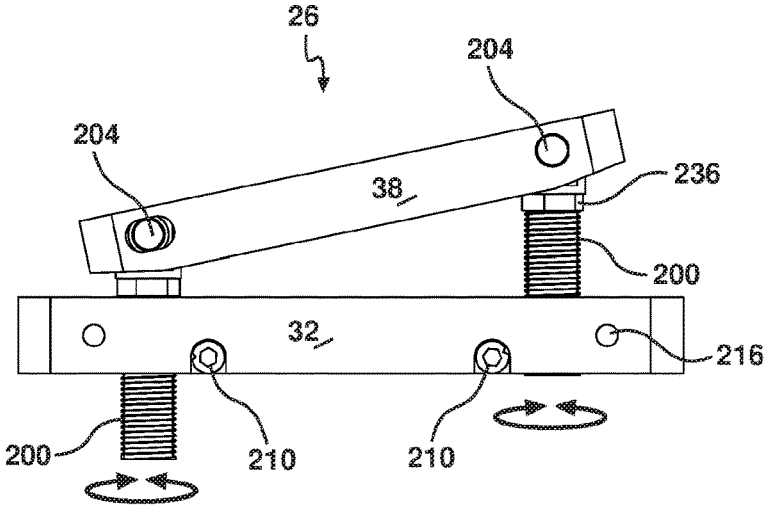
FIG. 63 is a side view of the adjustment mechanism in an alternate angled position.

A gunstock can be defined by several accepted measurements variously described as drop (at comb, face and heel), length of pull, cast and pitch (the terms vary with country but they all define the geometry of the gun stock). FIGS. 42 and 43, provide a visual indication of these terms.

Referring to the drawings for a more detailed description, there is illustrated an adjustable gunstock 10, demonstrating by way of examples, arrangements in which the principles of the present invention may be employed.

FIG. 1*a* illustrates one embodiment of the adjustable gunstock 10 incorporated into a firearm 12. The adjustable gunstock 10 includes a stock body 14 fixedly connected to a barrel 16. The firearm 12 in the drawings has been simplified for the purposes of clarity. In the present embodiment the firearm 12 includes an adjustable comb member 18 and an adjustable butt member 20. A body engaging portion, being in the form of a comb 22, is attached to the adjustable comb member 18, and a body engaging portion, being in the form of a butt 24 is attached to the adjustable butt member 20.

As will become clear to the reader, the adjustment mechanism 26 of both the adjustable comb/butt members 18, 20 are overall similar in design and permit a multiplicity of adjustment positions. The adjustment mechanism 26 in the present embodiment is modified using socket receiving pinion 28 and socket receiving screw 30. The socket receiving pinion 28 and socket receiving screw 30 in one embodiment are configured to receive an Allen key of a single size.

The reader should appreciate that the configuration of the first and second adjustment members, which are positioned within the comb and butt of the stock body, may be generally similar in overall configuration and therefore the terms vertical and horizontal when used in relation to any one of the adjustment members, likewise covers horizontal and vertical in relation to the other adjustment member that has a different orientation.

Figure 1B:
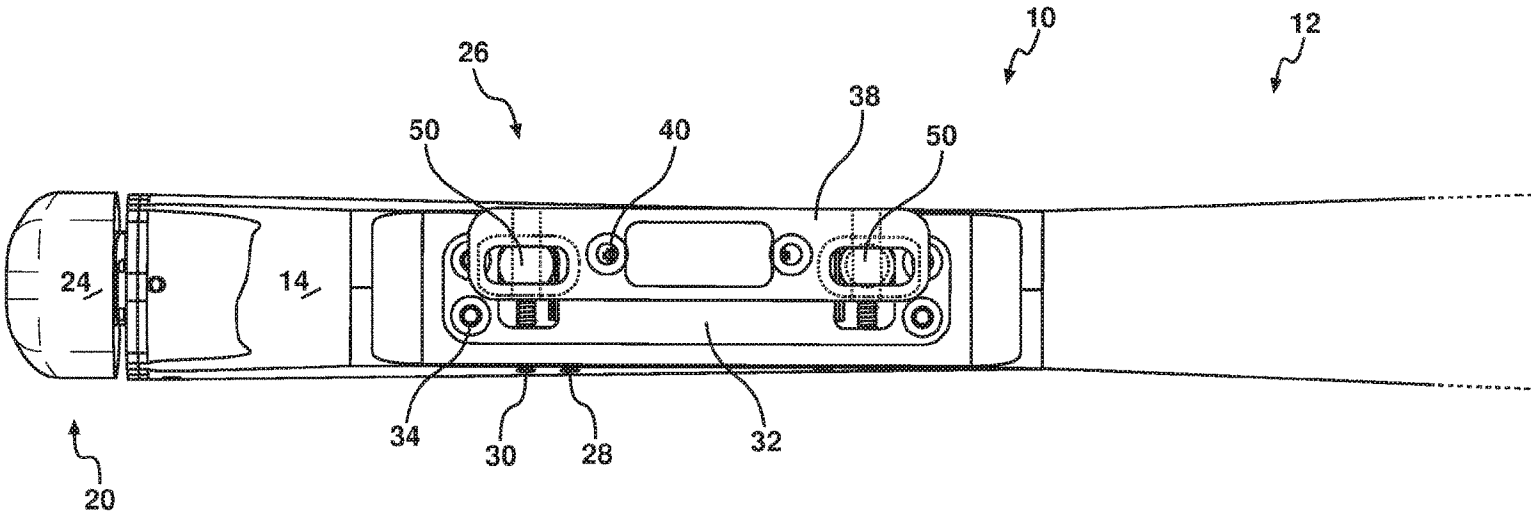
FIG. 1*b* is a top view of the firearm of FIG. 1*a* with comb portion removed illustrating the adjustment mechanism of the present invention.

As illustrated in FIG. 1*b*, the adjustment mechanism 26 of the adjustable gunstock 10, comprises a base 32 fixedly connected to the stock body 14 by way of screws 34. The base 32 is retained within a cavity 36 in the body 14, as is well known in the prior art.

The adjustment mechanism 26 further includes a mount 38 that adjustably engages the base 32. The comb 22 (or butt 24) is attached to the mount 38 using screws (not shown) that engage apertures 40. It should however be appreciated that the mount and the comb/butt may be unitary in construction.

Figure 2:
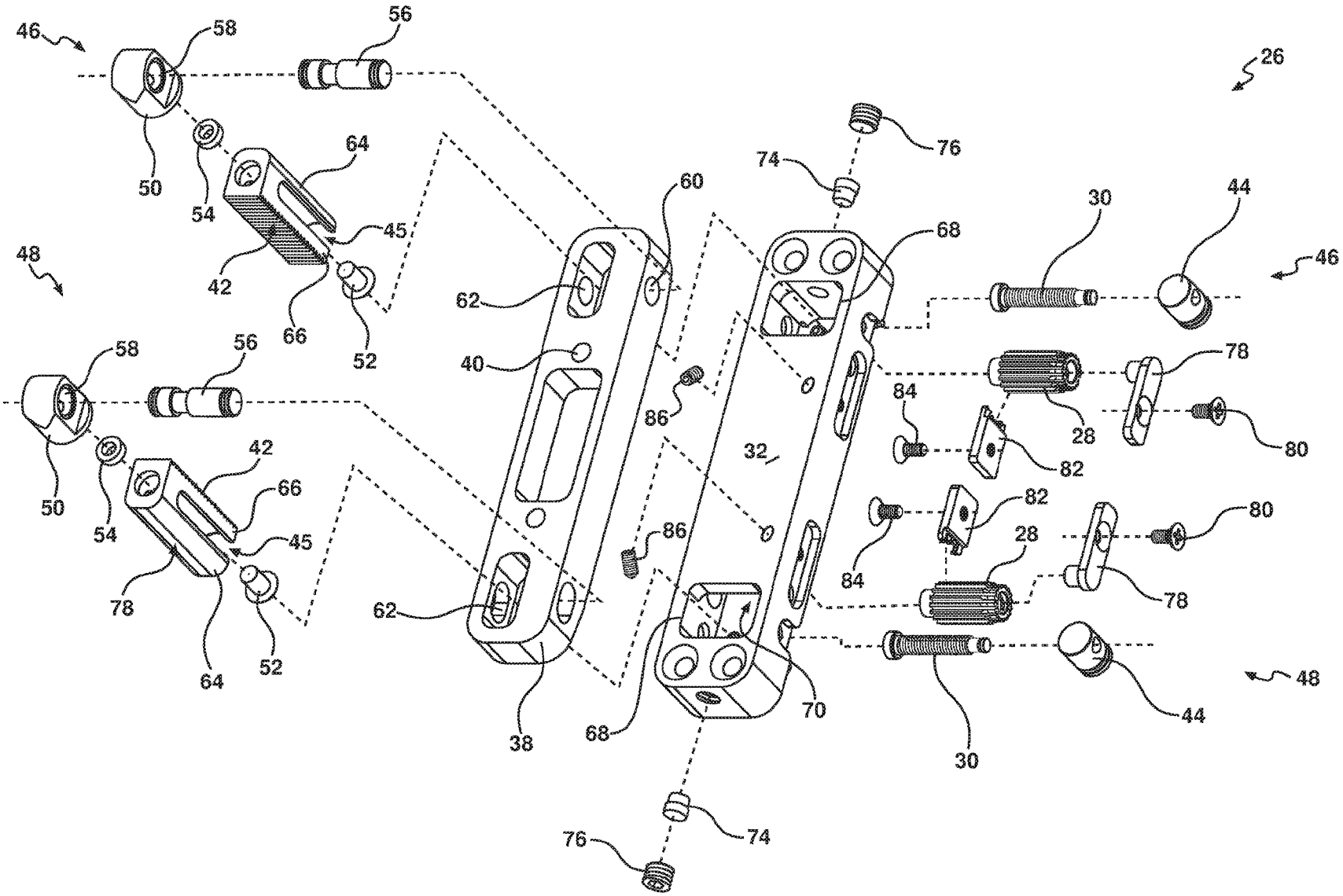
FIG. 2 is an exploded view of the adjustment mechanism of FIG. 1*b;*

Turning to FIG. 2, there is illustrated the components of the adjustment mechanism 26, which generally comprise a pair of racks 42 and respective pinions 28 for adjusting the mount 38, vertically in the case of the comb adjustable comb member 18, and horizontally away from, or towards, the body 14 in the case of the butt adjustment member 20. Each adjustment mechanism 26 also includes a relocation member, in the form of a socket head cap screw 30, which engages a threaded slidenut 44. The slidenut 44 is configured to engage a track 45 in or adjacent a respective rack 42. The reader will appreciate that each of the adjustable comb/butt members 18, 20, includes first and second adjustment members 46, 48. Accordingly, the discussion with respect to one adjustment member also applies to the other member.

Figure 3:
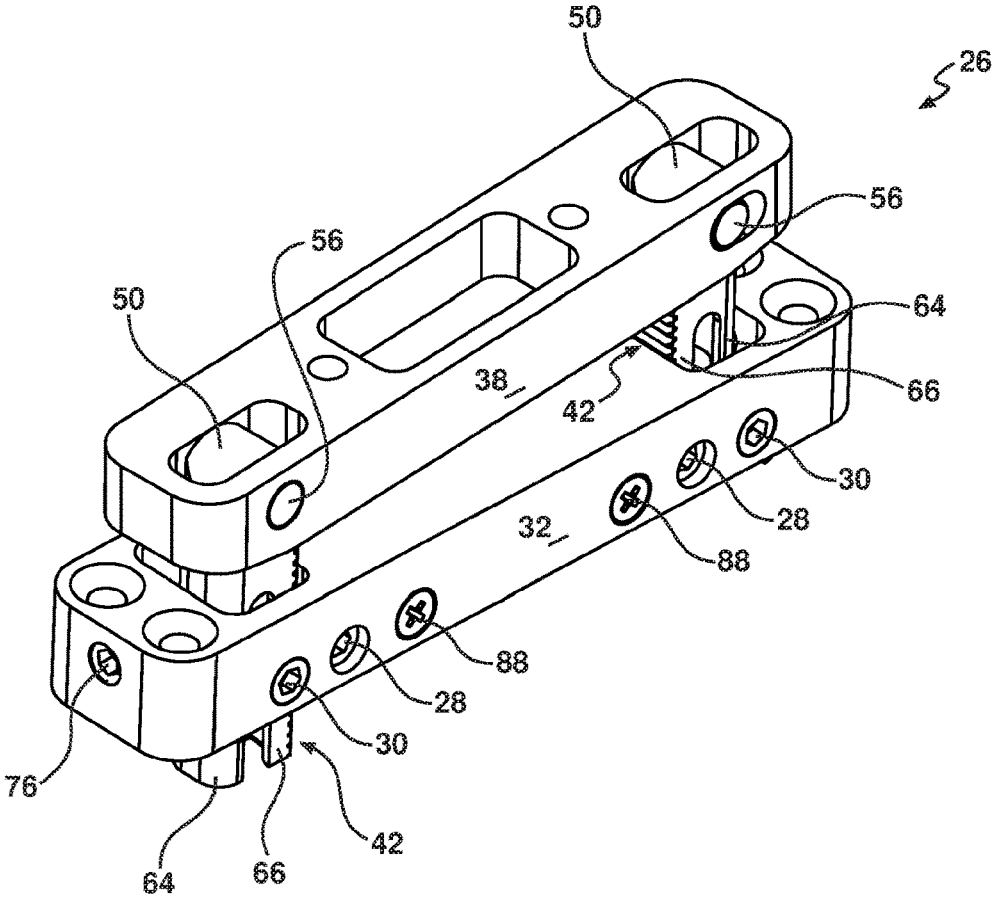
FIG. 3 is a perspective view of the adjustment mechanism of FIG. 1*b;*
Figure 22:
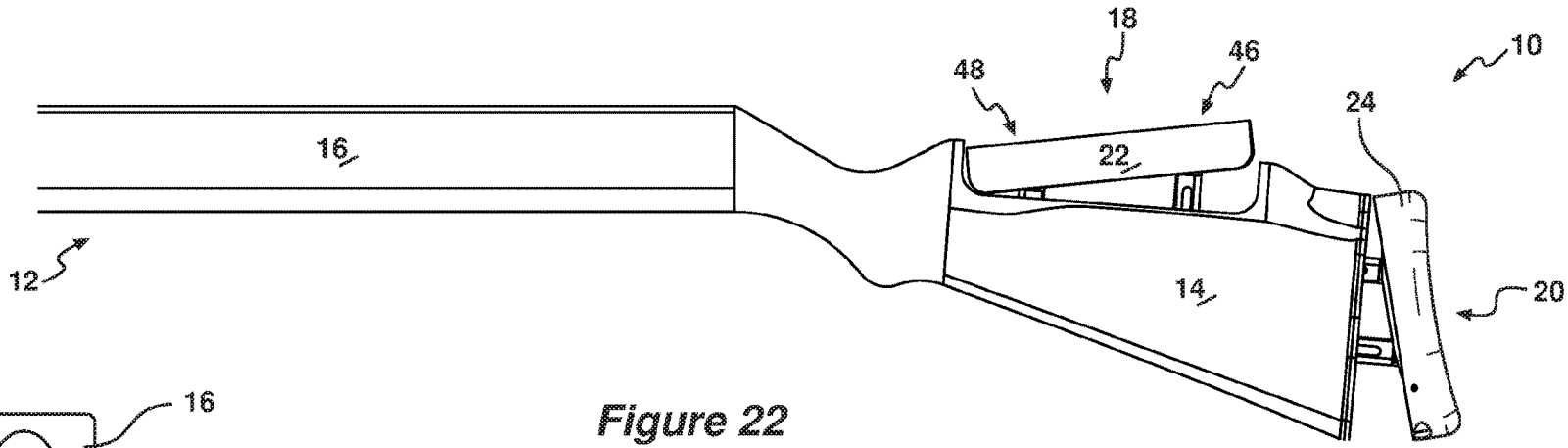
FIG. 22 is side view of adjustable gunstock of FIG. 1, illustrating the comb at an angle to the horizontal and the butt "heel in", to thereby alter the degree of pitch of the gun.

The first and second adjustment members 46, 48 each including a rack 42, which is connected to a clevis 50, by way of button head screw 52 that also engages a respective bush 54. The clevis 50 is held in pace within the mount 38 by way of pin 56, which engages through hole 58 in the clevis 50, and holes 60, 62 in the mount 38. This configuration means that the rack 42 is able to rotate around the pin 56, when the mount 38 is set at an angle as illustrated in FIG. 22. The outwardly extending fingers 64, 66, which form the track 45 therebetween, are configured to engage through a respective opening 68 in the base 32, as illustrated in FIG. 3.

Figure 6:
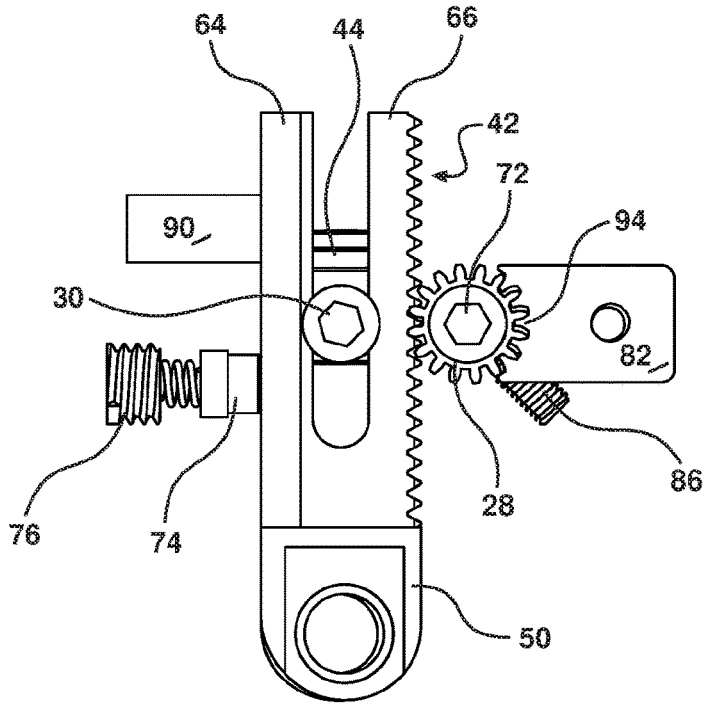
FIG. 6 is an underside view of the rack and pinion assembly of FIG. 5.

Turning back to FIG. 2, each of the adjustment members 46, 48, includes a pinion 28 that is rotatably attached to the base 32, within a void 70. The pinion 28 includes a socket receiving portion 72, as illustrated in FIG. 6, to thereby facilitate adjustment of the rack 42 and pinion 28 to move the mount 38.

Figure 4:
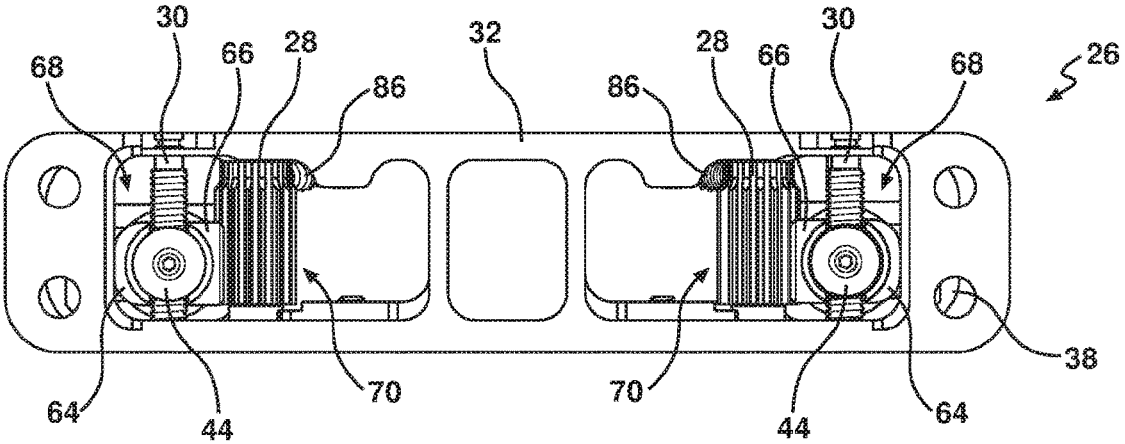
FIG. 4 is an underside view of the adjustment mechanism of FIG. 3.

The reader will appreciate that the respective openings 68 and voids 70 are adjoining, wherein the rack 42 is positioned for engagement with a corresponding pinion 28, as can be seen in FIG. 4.

The slug 74, which is held in place by grub screw 76, bears against an outer surface 78 of the finger 64, to maintain engagement between the rack 42 on finger 66 and the pinion 28. The primary purpose of the slug 74 is to take up 'backlash' so that finger 64 is inhibited from rocking.

The pinion 28 is held in place within the void 70 by way of dowel member 78 that is held in place by screw 80.

The adjustment members 46, 48, further include a lock plate 82, that is rigidly connected to the base 32 by way of screw 84.

Figure 5:
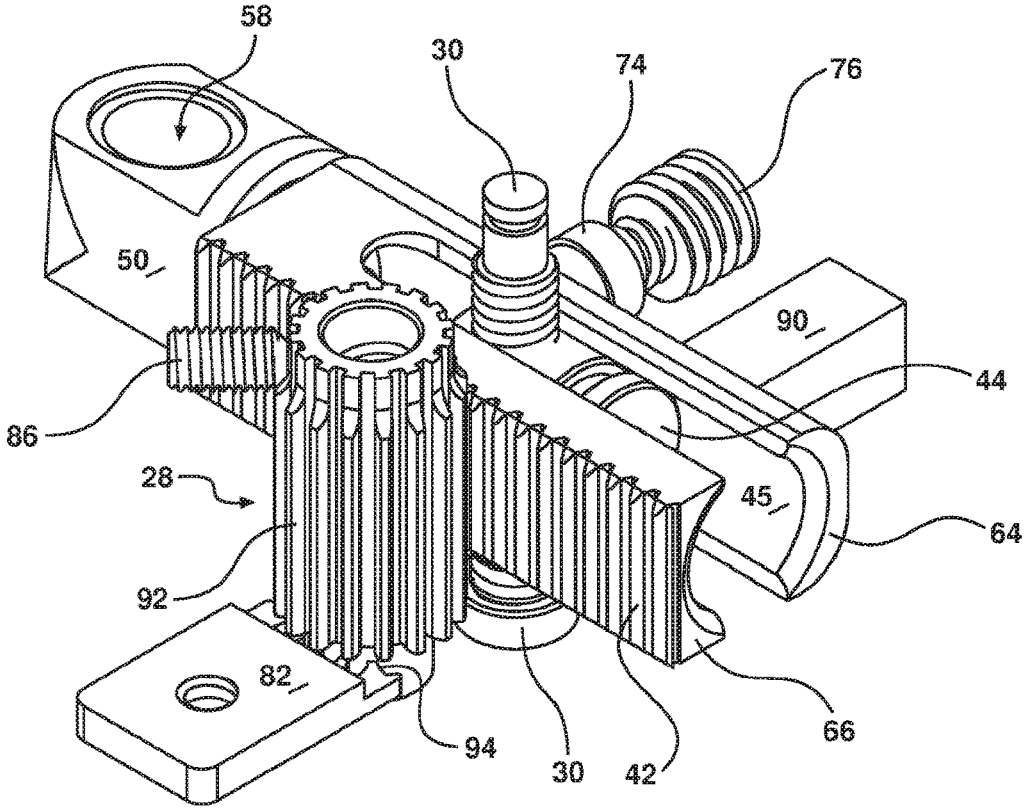
FIG. 5 is a perspective view of the adjustable rack and pinion assembly of FIG. 1*b;*
Figure 7:
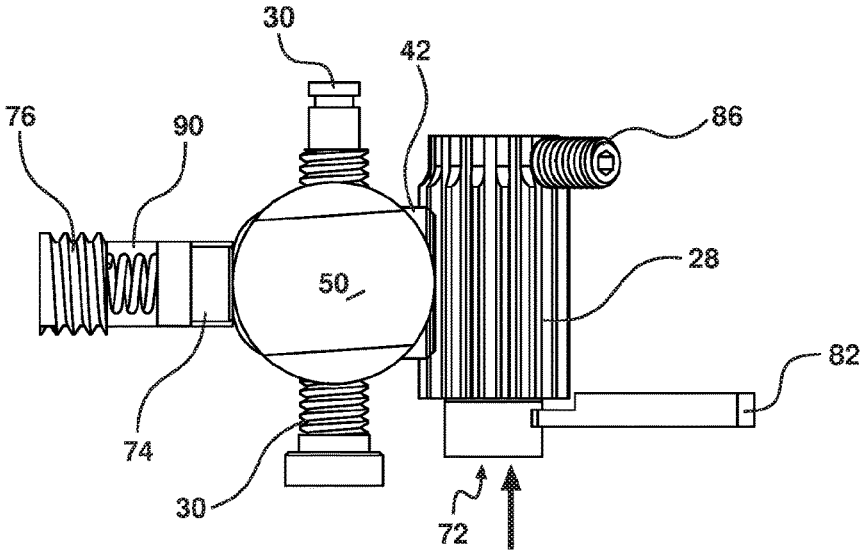
FIG. 7 is a rear view of the rack and pinion assembly of FIG. 5.
Figure 8:
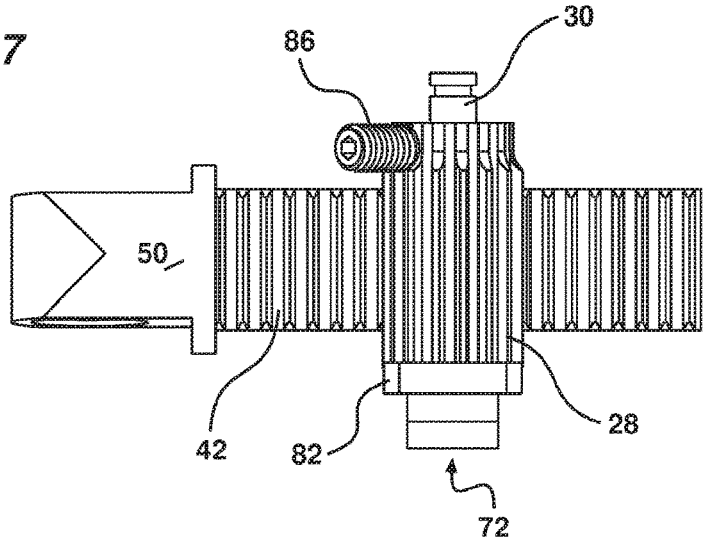
FIG. 8 is a side view of the rack and pinion assembly of FIG. 5.
Figure 9:
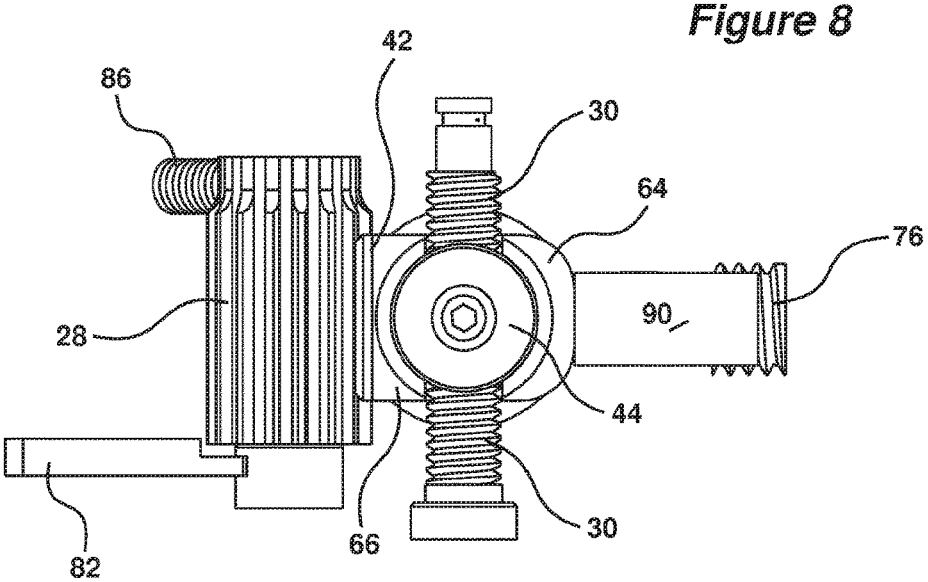
FIG. 9 is a front view of the rack and pinion assembly of FIG. 5.

The pinion 28 is biased by way of spring grub screw 86 into engagement with the lock plate 82, as illustrated in FIGS. 4 and 5, such that the pinion 28 is inhibited from moving during firing of the firearm 12. This inhibits the gun fit from inadvertently changing as a result of operation of the firearm 12. To move the pinion 28, to thereby adjust the rack 42, longitudinal pressure is applied to the pinion, in the direction of the arrow in FIG. 7, against the biasing of spring grub screw 86. This moves the helical teeth 92 of the pinion 28 out of engagement with the cooperatingly shaped slots 94 of the lock plate 82, as shown in FIG. 5. In this position the pinion 28 can be rotated to adjust the rack 44.

When the longitudinal pressure is removed the spring grub screw 86 moves the pinion 28 such that the helical teeth 92 and slots 94 engage to thereby hold the pinion 28 is place against rotation.

Various screws and clips, such as screws 88, may be used to assemble the adjustment members 46, 48, but will not be discussed in detail.

As illustrated in FIGS. 5 to 9, the adjustment members 46, 48, further include a support 90 that also bears against the outer surface 78 of the finger 64, to maintain engagement between the rack 42, on finger 66, and the pinion 28.

The skilled addressee will now appreciate that the slidenut 44 permits free longitudinal movement of the fingers 64, 66 and therefore the rack 42, relative to the socket head cap screw 30. However, the lateral movement of the rack 42 relative to the pinion 28 can be adjusted by rotation of the socket head cap screw 30 which thereby moves the position of the slidenut 44 therealong to thereby laterally reposition the rack 42 across the face of the pinion 28.

Figure 10:
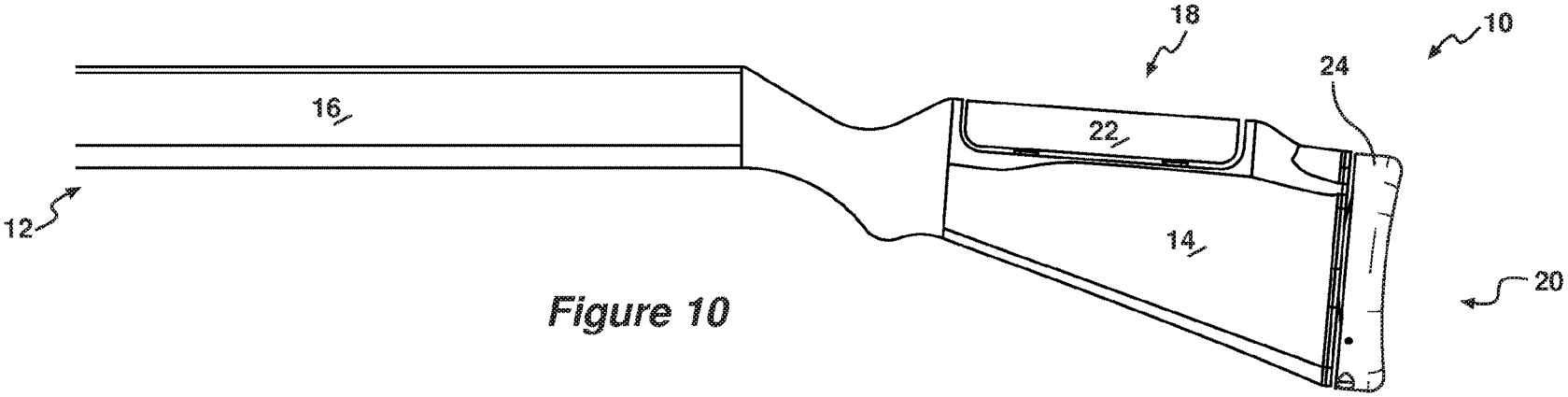
FIG. 10 is reserve side view of firearm of FIG. 1, illustrating the comb and butt in a neutral position.
Figure 11:
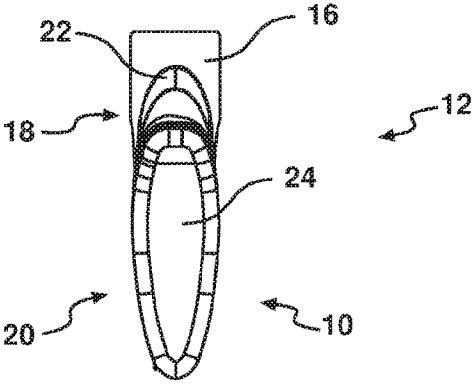
FIG. 11 is a rear end view of adjustable gunstock of FIG. 10.
Figure 12:
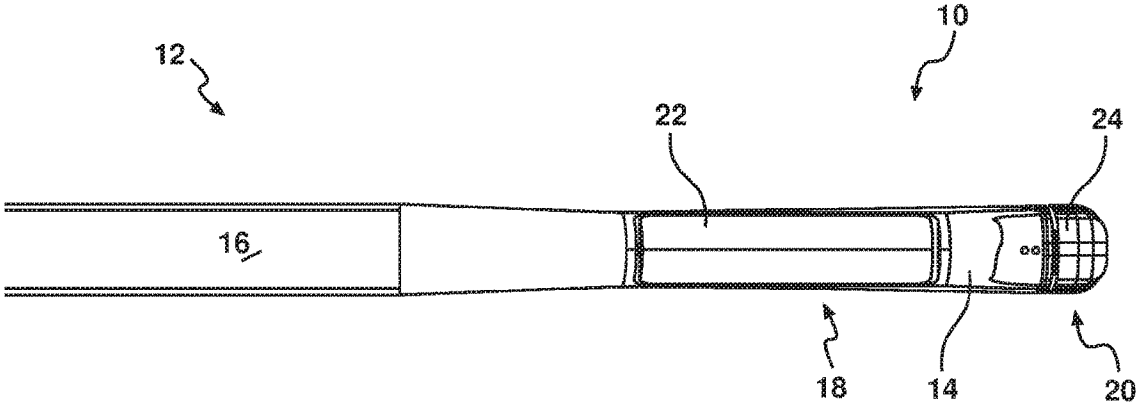
FIG. 12 is a top view of adjustable gunstock of FIG. 10.
Figure 13:
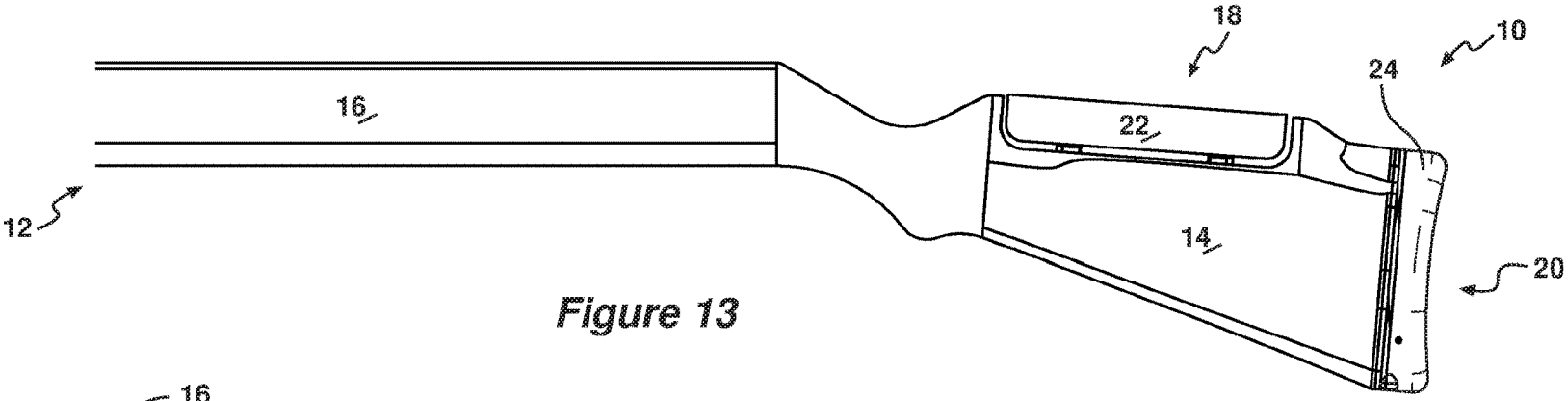
FIG. 13 is reserve side view of adjustable gunstock of FIG. 1, illustrating the comb and butt in horizontally offset positions.
Figure 15:
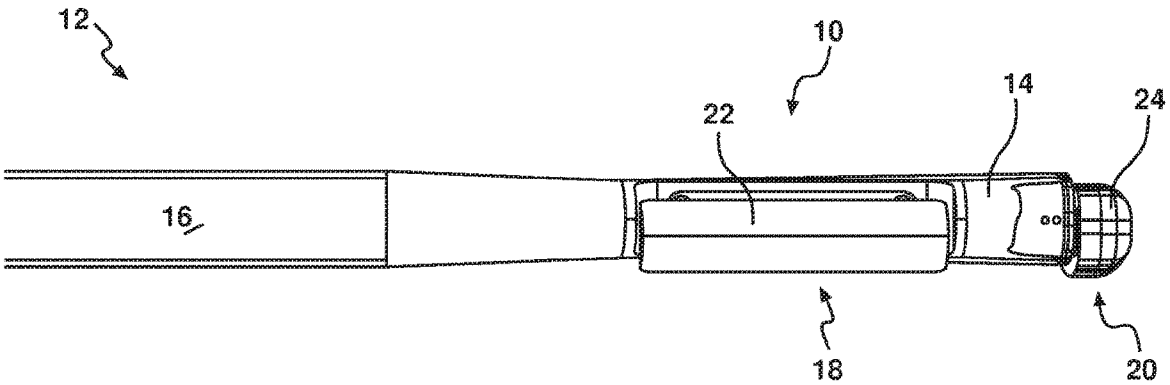
FIG. 15 is a top view of adjustable gunstock of FIG. 13.
Figure 14:
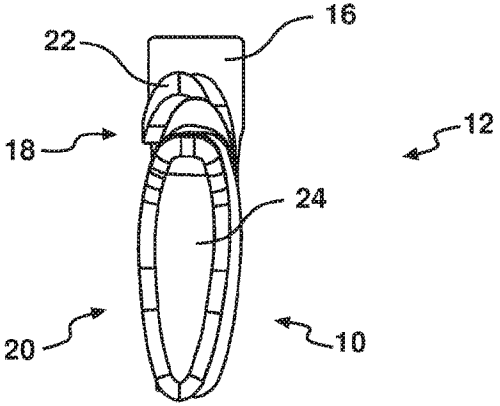
FIG. 14 is a rear end view of adjustable gunstock of FIG. 13.

FIGS. 10 to 26, illustrated different configuration in which the adjustable comb/butt 18, 20 can be positioned to provide gun fit for the shooter. The reader will appreciate that other orientations are possible and the figures are provided to simply illustrate the movement. FIGS. 10 to 12 illustrate the adjustable gunstock having the comb and butt in a neutral position. This arrangement is further illustrated in FIG. 27. FIGS. 13 to 15 illustrate the operation of the socket head cap screw 30 of both the adjustment members 46, 48, to thereby position the comb portion 22 and butt portion 24 in a horizontally offset position from the body 14.

It should be appreciated that the comb portion 22 and butt portion 24 may be offset to one side more than the other. Guns are normally preferentially adjusted in one direction. For instance, it may be adjusted 7 mm one way and only 2 mm in the other direction. The reader should also appreciate that the mount 38 can be reversed, if the adjustment is required on the other side of the firearm, for instance where the firearm be going from a right-handed user to a left-handed user or the other way.

Figure 16:
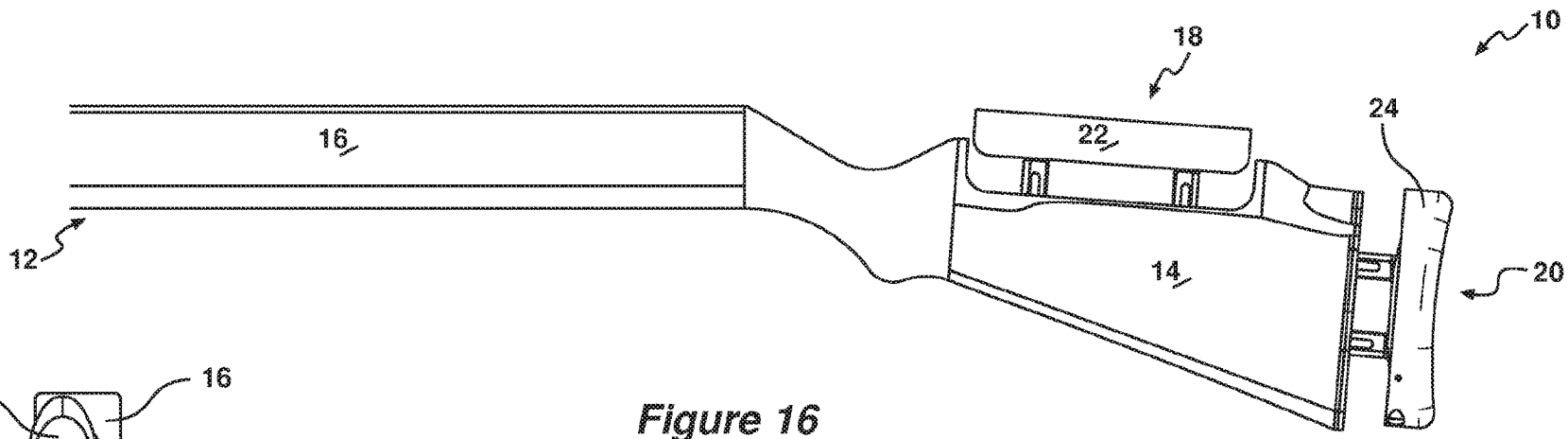
FIG. 16 is side view of adjustable gunstock of FIG. 1, illustrating the comb in a horizontally and vertically offset position, and the butt in a horizontally offset and rearwardly extended position.
Figure 17:
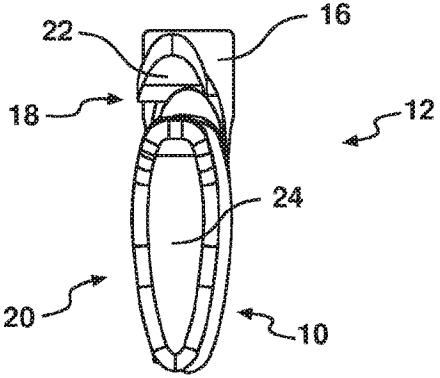
FIG. 17 is a rear end view of adjustable gunstock of FIG. 16.
Figure 18:
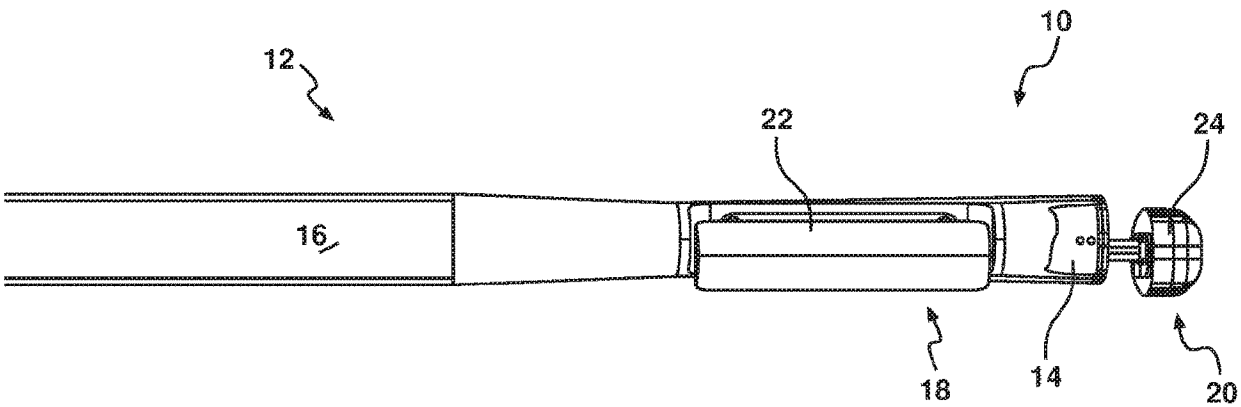
FIG. 18 is a top view of adjustable gunstock of FIG. 16.
Figure 19:
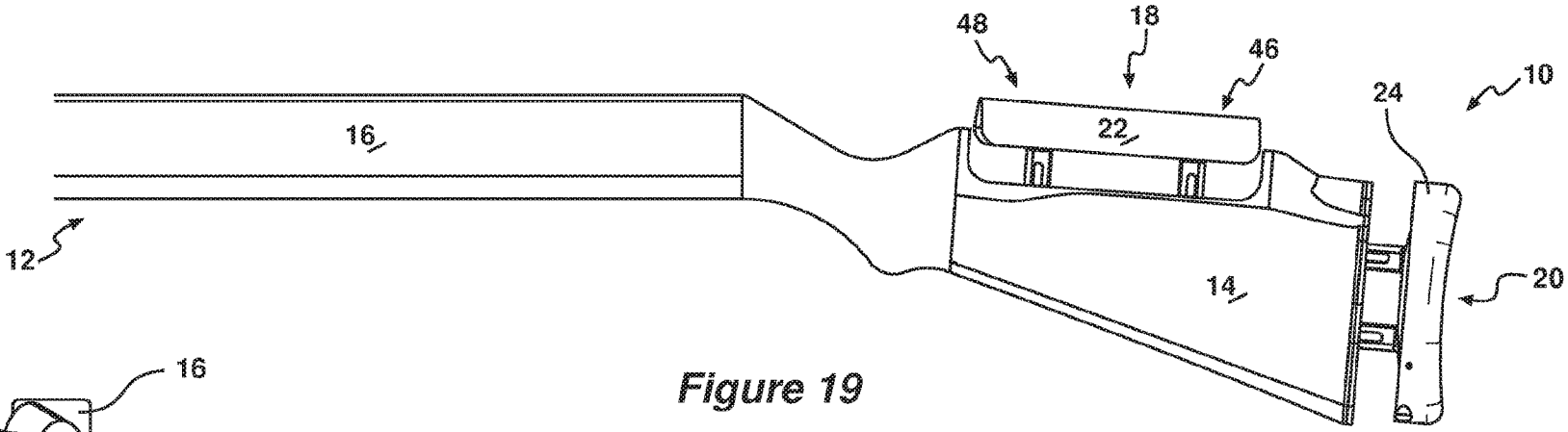
FIG. 19 is side view of adjustable gunstock of FIG. 16, further illustrating the comb in an offset position relative to the longitudinal axis of the firearm, and the butt rotated around the longitudinal axis.
Figure 21:
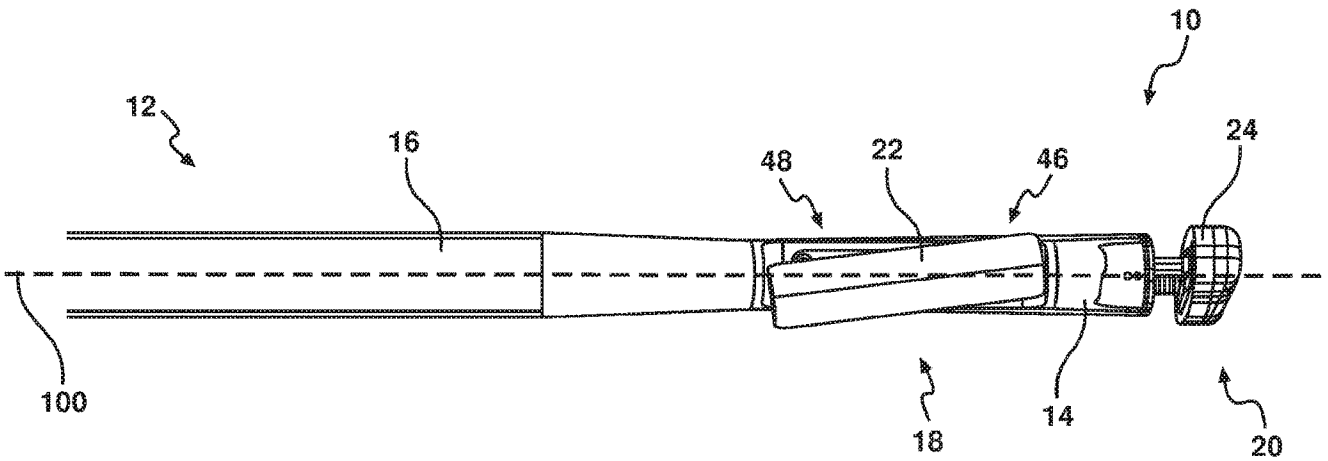
FIG. 21 is a top view of adjustable gunstock of FIG. 19.
Figure 20:
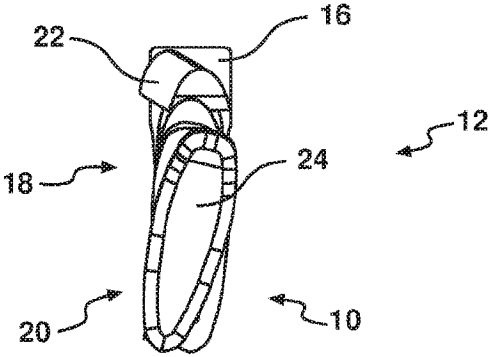
FIG. 20 is a rear end view of adjustable gunstock of FIG. 19.
Figure 28:
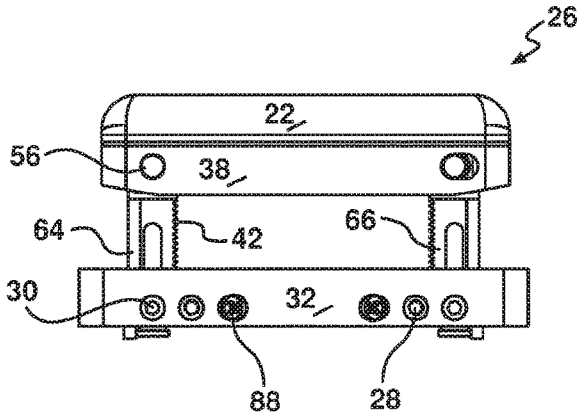
FIG. 28 is a side view of the comb portion of the adjustable gunstock of FIG. 1 in a raised position.

FIGS. 16 to 18, illustrate the operation of the rack 42 and pinion 28 to move the comb portion 22 vertically away from the body, and the butt portion 24 horizontally away from the body 14. This arrangement is further illustrated in FIG. 28. As the reader would appreciate, different adjustments of the socket head cap screws 30 and racks 42/pinions 28 will position the comb portion 22 or butt portion 24 in different orientations. For instance, as illustrated in FIGS. 19 to 21, the socket head cap screw 30 of the first and second adjustment members 46, 48 are adjusted differently such that the respective slidenuts 44 are located at different relative positions therealong. This results in the comb portion 22 and butt portion 24 being angled relative to, or rotated around the longitudinal axis 100 of the firearm 12, as illustrated in FIG. 21.

Figure 24:
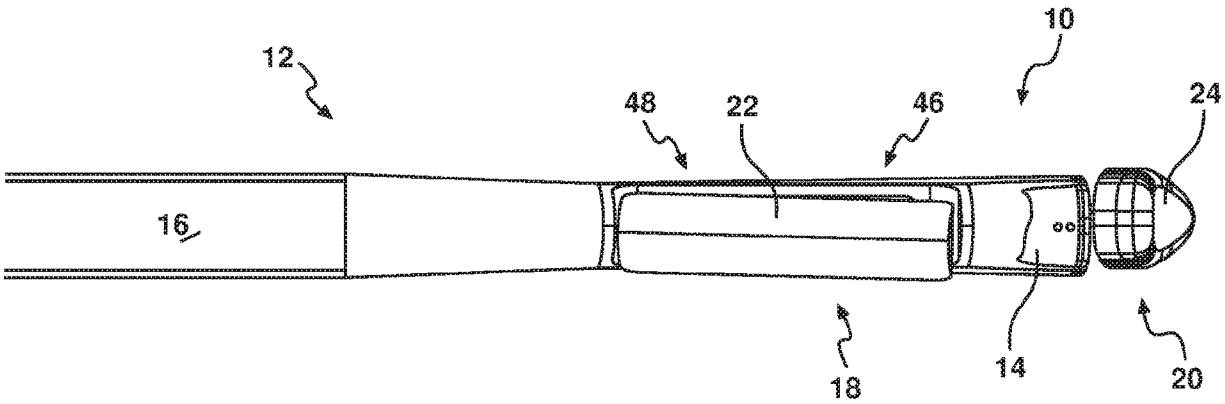
FIG. 24 is a top view of adjustable gunstock of FIG. 22.
Figure 23:
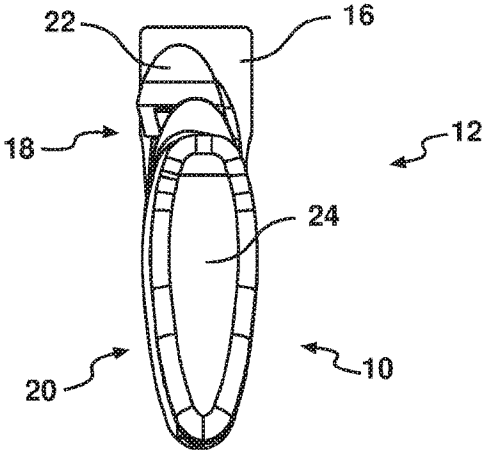
FIG. 23 is a rear end view of adjustable gunstock of FIG. 22.
Figure 29:
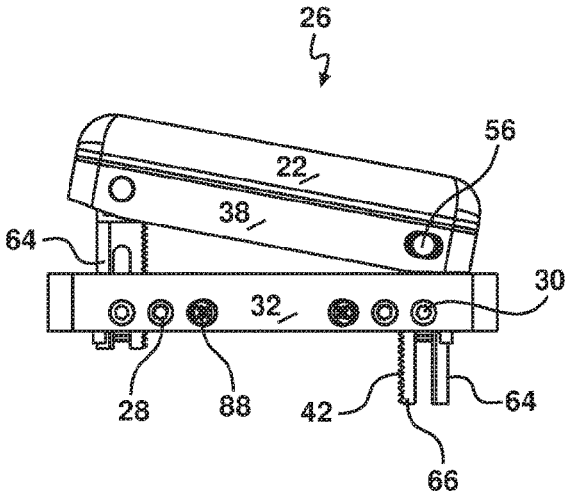
FIG. 29 is a side view of the comb portion of the adjustable gunstock of FIG. 1 in an angled position.
Figure 30:
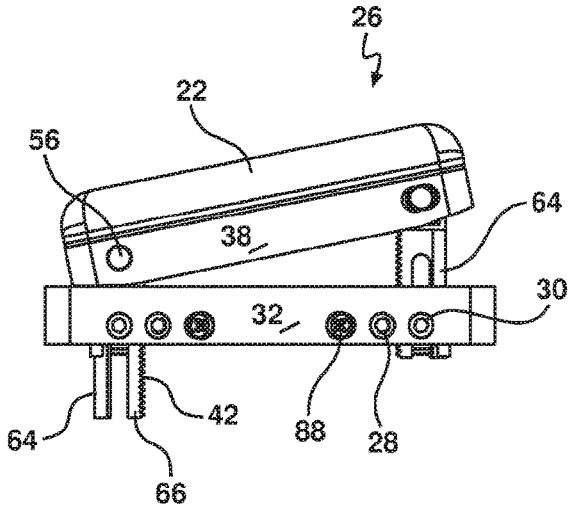
FIG. 30 is a side view of the comb portion of the adjustable gunstock of FIG. 29 in a reverse angled position.

FIGS. 22 to 24 illustrate the racks 42/pinions 28 of the first and second adjustment members 46, 48 being adjusted differently to position the comb portion 22 or butt portion 24 at an angle to the neutral position. This arrangement is further illustrated in FIGS. 29 and 30.

Figure 25:
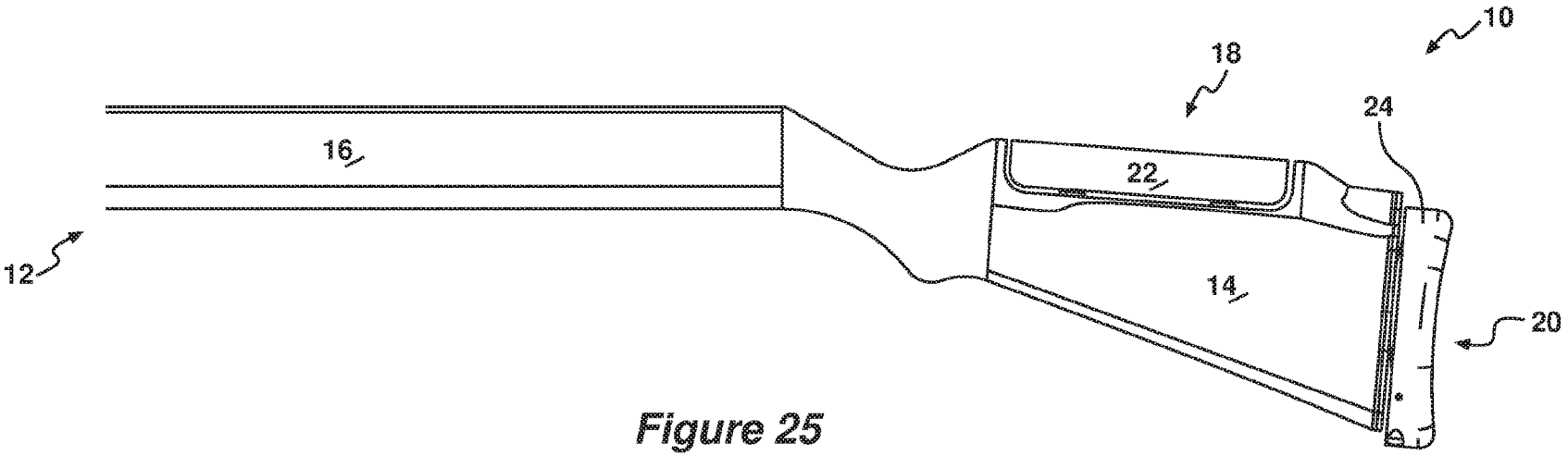
FIG. 25 is a side view of the adjustable gunstock of FIG. 1, illustrating the butt in a vertically lowered position.
Figure 26:
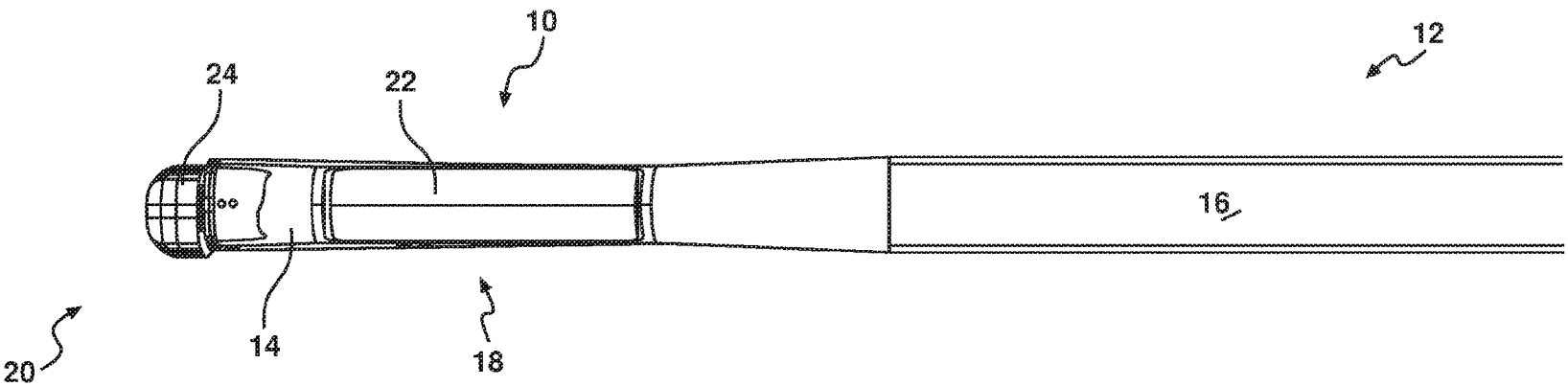
FIG. 26 is a top view of the adjustable gunstock of FIG. 1, illustrating the butt of the firearm in a horizontally offset position to adjust the cast-off.
Figure 27:
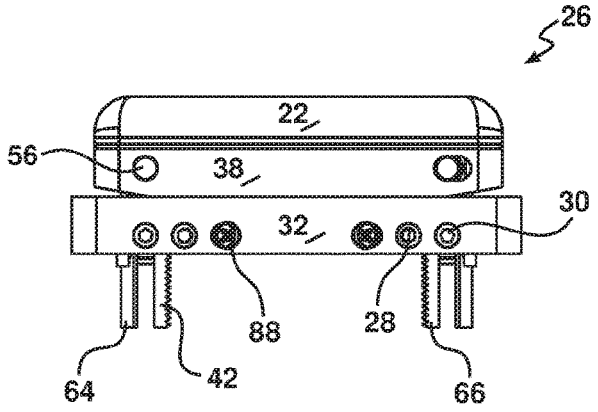
FIG. 27 is a side view of the comb portion of the adjustable gunstock of FIG. 1 in a neutral position.
Figure 33:
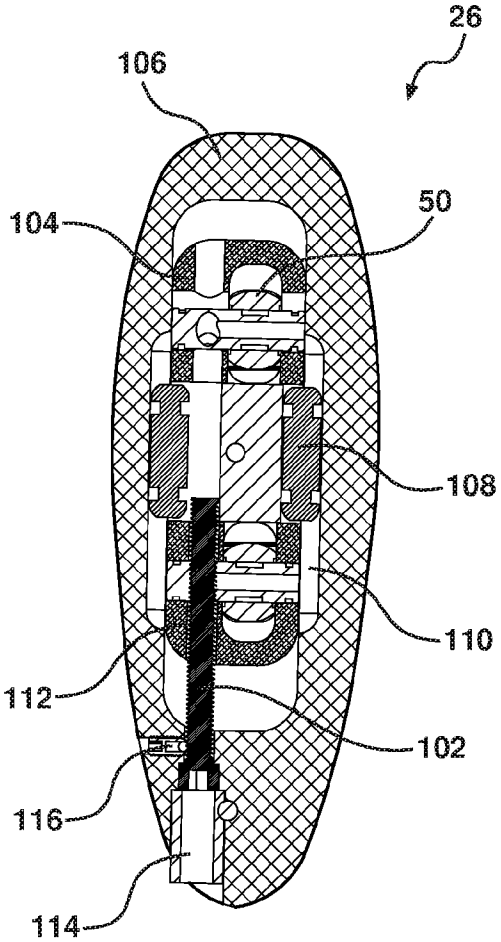
FIG. 33 is a cross-sectional view through A-A of the outer portion of FIG. 32, illustrating the vertical adjustment assembly for moving the butt vertically relatively to the gunstock.
Figure 32:
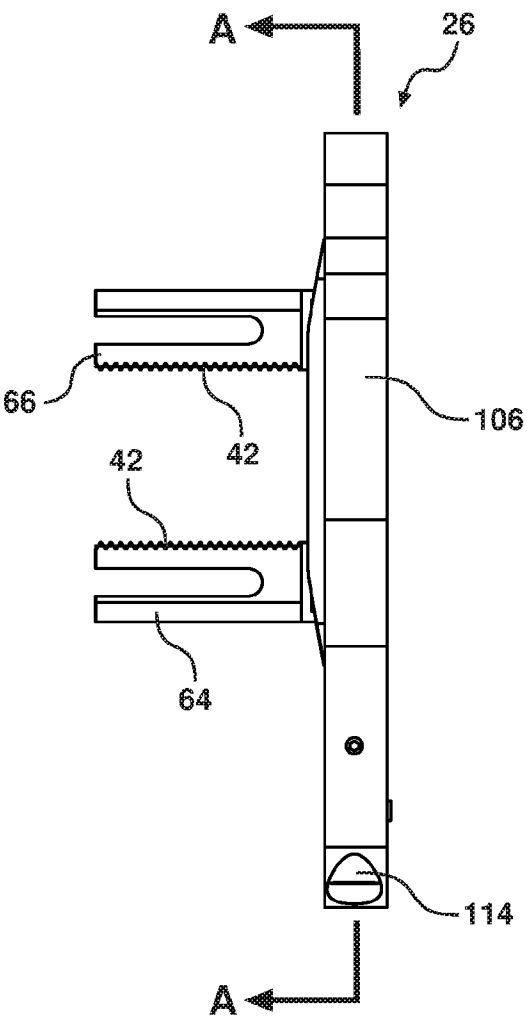
FIG. 32 is a side view of the butt end adjustment mechanism of FIG. 31, illustrating the opposing racks.
Figure 31:
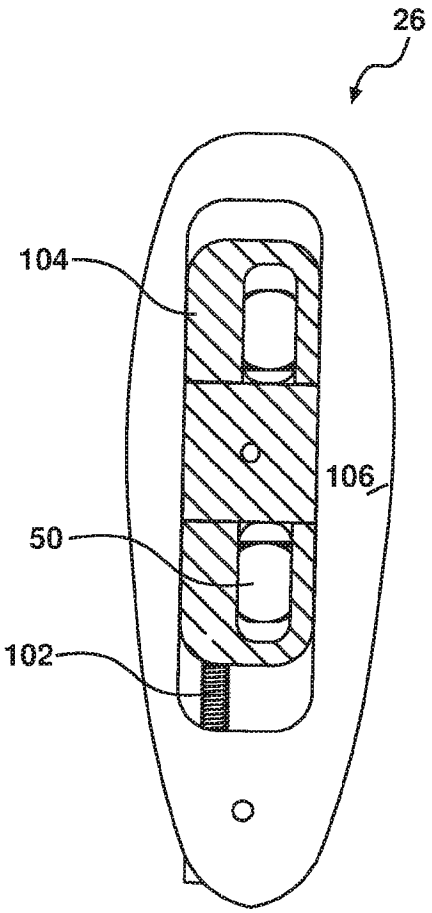
FIG. 31 is a rear view of the inner mount portion and outer mount portion of the butt end adjustment mechanism of FIG. 1 with butt portion removed.

FIG. 25, illustrated the movement of the butt portion 20 vertically relative to the body 14, by way of a screw member 102 that will be discussed with respect to FIGS. 31 to 33. The use of the screw member 102 does not prevent operation of the socket head cap screw 30, as illustrated in FIG. 26 or the operation of the racks 42/pinions 28, such as to adjust the cast-off of the gun.

Turning to FIGS. 31 to 41, the mount 38 of the adjustable butt member 20 includes an inner mount portion 104 and an outer mount portion 106. Sliding pins 108 are connected to the inner mount portion 104 and engage respective sliding tracks 110 in sides of the outer mount portion 106. The position of the inner mount portion 104 is adjusted by way of screw member 102, which is rotatably connected to the outer mount portion 106, by securing means 114 and engages threaded shaft 112 of the inner mount portion 104. A detent ball 116 is used to provide an auditory indication of the number of rotations.

The reader should appreciate that the socket head cap screw 30 and pinion 28 may also have detent balls or similar to indicate the number of rotations. This auditory sound is used to indicate to the user the amount of change that would occur by the adjustment. As the skilled addressee will appreciate, minutes of angle (MOA) is the basic unit of measurement on target knobs, wherein one click results in a change of ¼ Inch at 100 yards. The present invention, can therefore use the same well-known technique to indicate the amount of change in aim the adjustment will have on the firearm 12. In this way the butt portion 24 can be move vertically relative to the body 14, as previously illustrated in FIG. 25.

Figure 34:
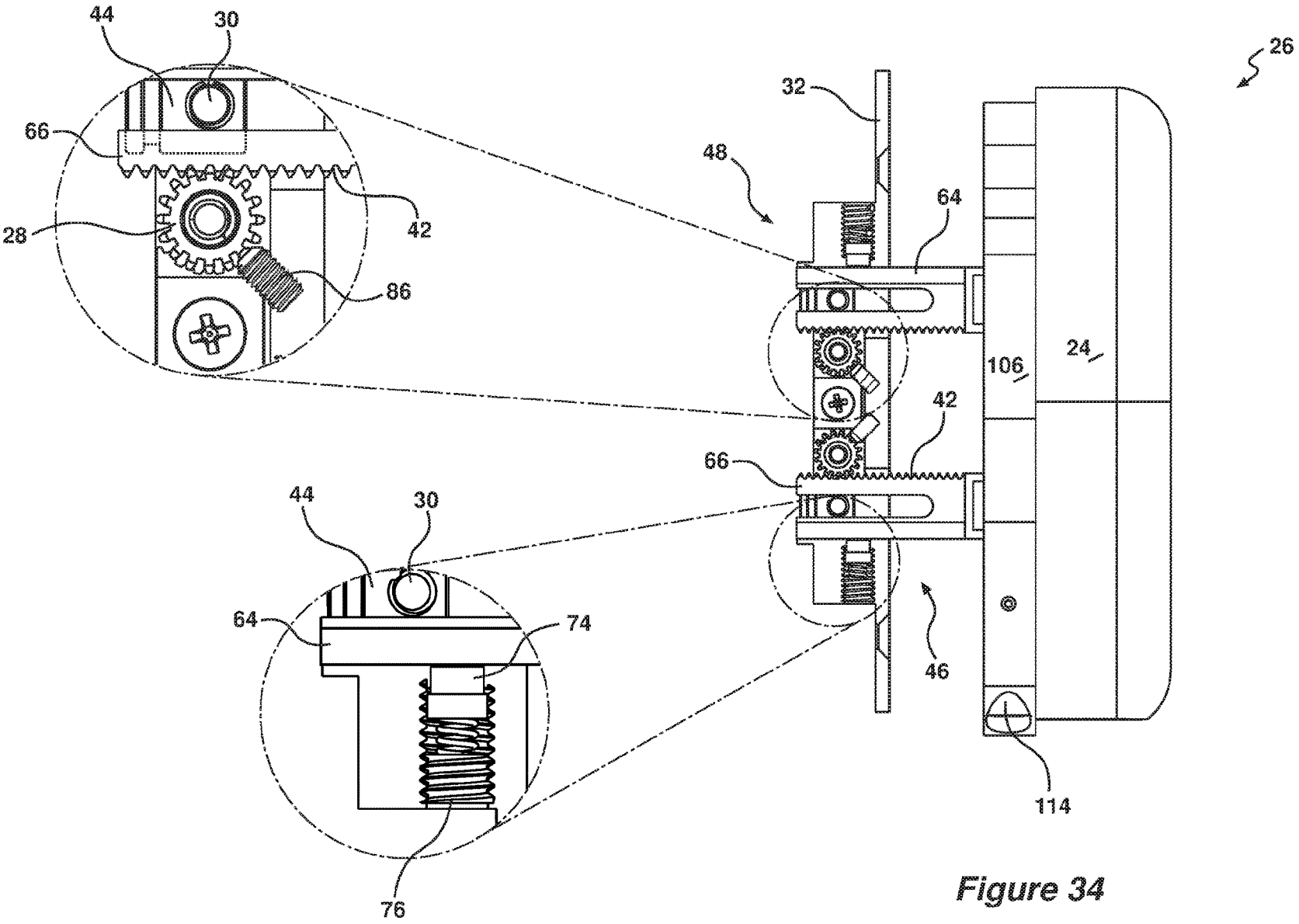
FIG. 34 is a side view of the butt end adjustment mechanism with butt portion of a second embodiment attached.
Figure 35:
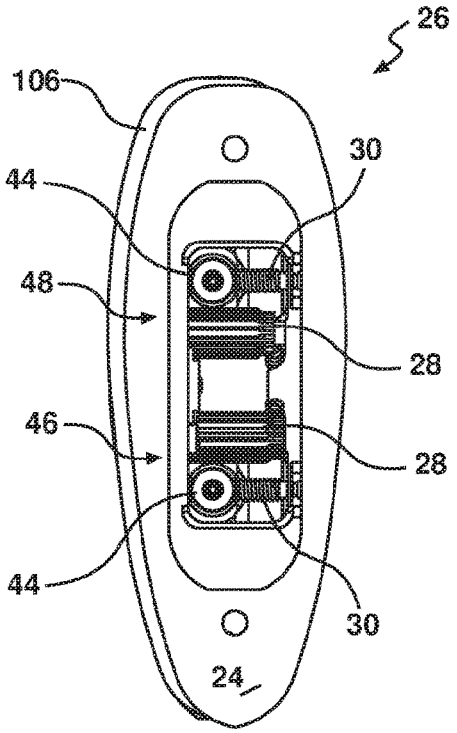
FIG. 35 is a front view of the butt end adjustment mechanism of FIG. 34 in a first horizontal position.
Figure 36:
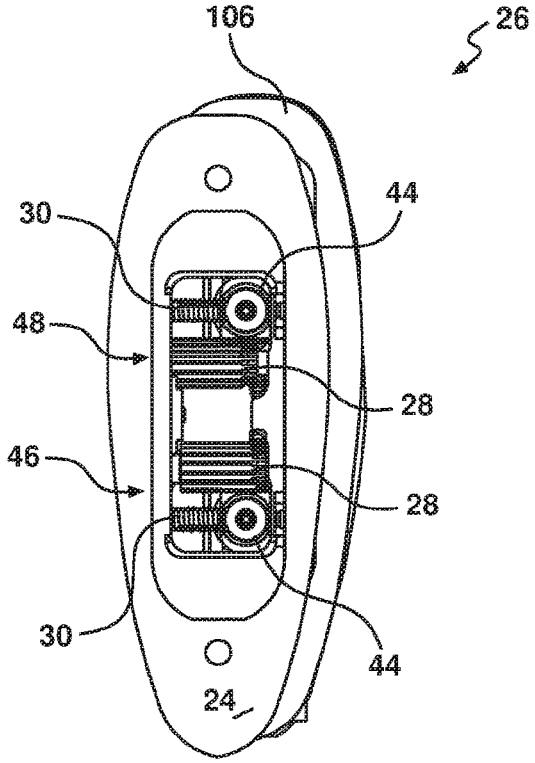
FIG. 36 is a front view of the butt end adjustment mechanism of FIG. 35 in a second horizontal position.
Figure 37:
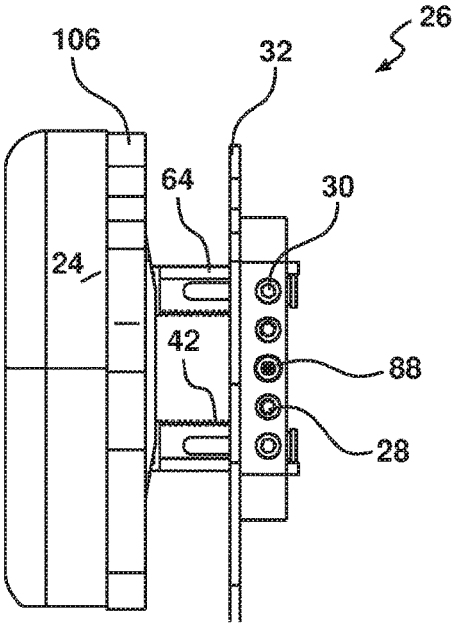
FIG. 37 is a side view of the butt end of FIG. 34 is an extended position.
Figure 38:
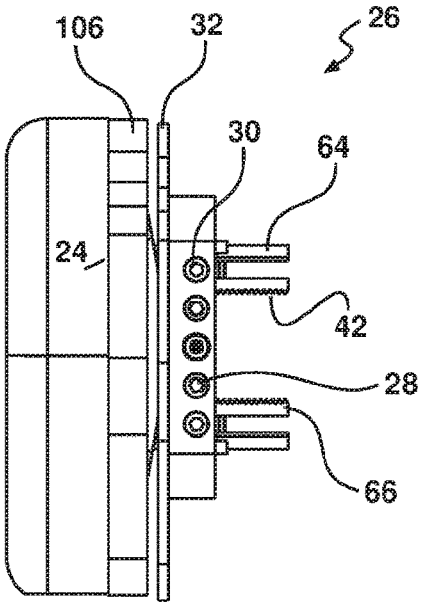
FIG. 38 is a side view of the butt end of FIG. 34 in a neutral position.
Figure 39:
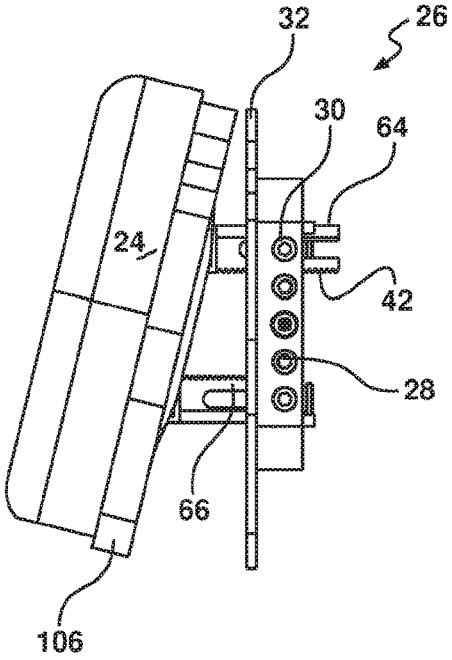
FIG. 39 is a side view of the butt end of FIG. 34 in an angled position.
Figure 40:
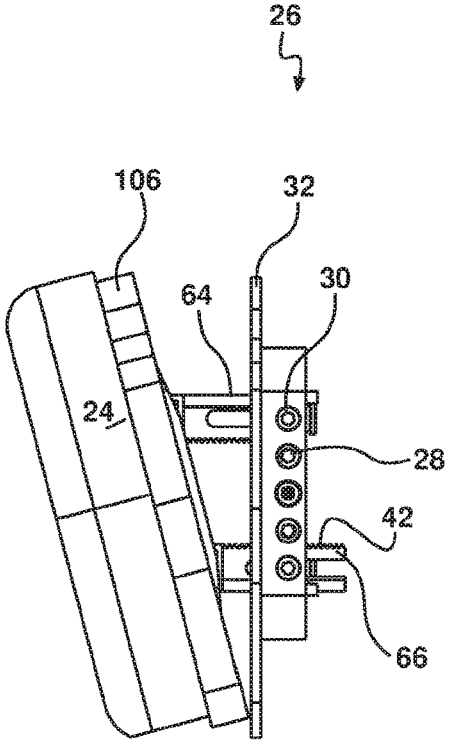
FIG. 40 is a side view of the butt end of FIG. 39 in a reverse angled position.
Figure 41:
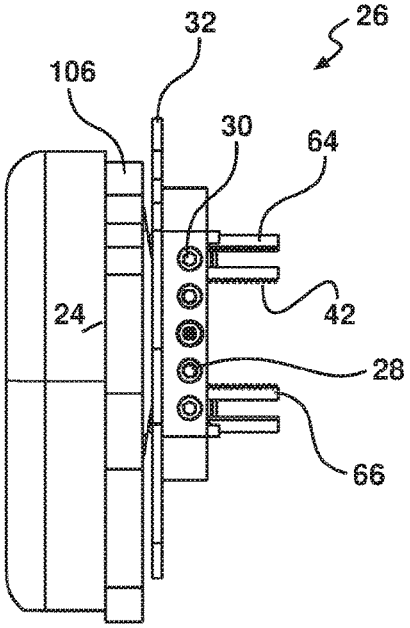
FIG. 41 is a side view of the butt end of FIG. 34 in a vertically lowered position.

As shown in FIG. 34, the components of the first and second adjustment members 46, 48 are generally identical and can operate in the same way as discussed above. Whereby, the butt portion 24 can be offset to the right or left, as illustrated in FIGS. 35 and 36, or in an extended position, or neutral position, as illustrated in FIGS. 37 and 38, or angled as illustrated in FIGS. 39 and 40. The configuration of the mount 38 having inner and outer mount portions 104, 106, also allows for the vertical repositioning of the butt portion 24, as illustrated in FIG. 41.

FIGS. 44 to 64 illustrate an alternate embodiment of the adjustment mechanism 26 of the adjustable gunstock 10, comprises a base 32 connected to the stock body 14, and a mount 38 that adjustably engages the base 32, wherein the comb 22 (or butt 24) is attached to the mount 38 using screws (not shown) that engage apertures 40, as previously discussed.

The skilled addressee will appreciate that the present embodiment is similar to that previously discussed with the main difference being that the rack and pinion, illustrated in FIGS. 1 to 43 have been replaced with a vertical screw post 200 and slider block 202 arrangement. The operation of the present embodiment is similar to the previously disclosed embodiment and can include many of the additional features as disclosed above.

The present embodiment further includes top pivot pins 204 which engage holes 206, 208 in the mount 38. Cross screws 210, with respective E clips 212, are configured to engage a corresponding slider block 202 through aperture 214. The slider blocks 202 are slidable connected to the base 32, by way of cross slide pin 216, which allow sideways movement of the slider blocks 202, which in turn moves the mount 38 laterally relative to the base 32, in a similar fashion as has previously been discussed. The cross slide pins 216, engage through respective holes 218 in the base 32 and holes 220 in the slider blocks 202. Grub screws 222 and 224 engage the base 32 and slider blocks 202.

The vertical screw post 200, engage a top pivot clevis 226 and O-ring 228. Each top pivot clevis 226 includes an aperture 230 through which a respective top pivot pins 204 is configured to pass. Socket head screw 232 are configured to engage the post internal bushings 234 of the vertical screw posts 200, to thereby couple the vertical screw post 200 to a respective top pivot clevis 220.

The reader will appreciate that the immediately preceding embodiment utilises screws/lead screws to adjust both up/down and left/right, thereby replacing the rack and pinion configuration. A hex head 236 of the vertical screw post 200 allows for user interface by way of spanner. The left/right uses the same Allen key adjustment as was discussed with respect to FIG. 2. Many of the parts of the two embodiments are the same or have a similar function. The reader will appreciate that the phrase "vertical screw post" can also read "horizontal screw post" when the adjustment mechanism 26 is being used on the butt of the firearm.

The second embodiment has less components and works with lower tolerances, however the reader will appreciate that the above embodiments are included to illustrate the invention and various modifications may be undertaken, which fall within the spirit and scope of the invention.

The skilled addressee will now appreciate the advantages of the illustrated invention over the prior art. In one form the illustrated embodiments provide an adjustment member that can be used for an adjustable comb portion or butt portion. The adjustment member/s can be used to adjust the length of pull, degree of pitch and to compensate for the shooter physiological attributes.

Accordingly, the present invention offers greater (i.e. more degrees of freedom) and ease of adjustment that can be done quickly, without the need to disassemble the stock of the firearm. For instance, when flicking between lens to best determine eyewear, existing adjustment systems typically require time and disassembly of the firearm before a new fit is established. This delay makes the comparison with the previous fit more difficult. With the present invention this change can be quickly made and then precisely reversed in order to evaluate.

The adjustable gunstock of the present invention can be made to fit a wide range of shooters. Changes can also be made on a day to day basis when, for instance, a shooter wears a jumper or puts on/loses weight over time. Another advantage is that the system can be included in new stocks or retrofitted to existing, comb or butt portions or both. Furthermore, the system keeps the wooden stock 'look' which is desired by those shooters that 'like' a traditional looking gun, in contrast to some adjustable stock firearms.

Various features of the invention have been particularly shown and described in connection with the exemplified embodiments of the invention, however it must be understood that these particular arrangements merely illustrate the invention and it is not limited thereto. Accordingly, the invention can include various modifications, which fall within the spirit and scope of the invention.

The invention claimed is:

1. An adjustable gunstock, comprising:

a base fixedly connectable to a stock body of a firearm;

a mount adjustably engageable with the base, the mount, or a part attachable thereto, forming a shooter's body engaging portion;

a first relocation member comprising a first screw post configured to engage a corresponding first slider block, the first screw post being pivotably connected to the mount and the first slider block being slidably connected to the base;

a second relocation member being spaced apart from the first relocation member, the second relocation member comprising a second screw post configured to engage a corresponding second slider block, the second screw post being both pivotably and slidably connected to the mount, the second slider block being slidably connected to the base;

the first screw post and the second screw post being configured to independently adjust the mount relative to the base in a first direction being away from or towards the stock body of the firearm; and the first slider block being engaged by a first cross screw which is couplable to the mount, and the second slider block being engaged by a second cross screw which is couplable to the mount at a position spaced apart from the first slider block, whereupon rotation of the first cross screw or the second cross screw moves the corresponding first slider block or second slider block to thereby adjust the mount relative to the base in a second direction being laterally of the stock body of the firearm.

2. The adjustable gunstock in accordance with claim 1, wherein the first and second adjustment members each comprise a rack and cooperating pinion, wherein the rack is pivotably couplable to the mount.

3. The adjustable gunstock in accordance with claim 1, wherein the first slider block and second slider block are positioned at least partly within a comb region and/or a butt region of the stock body, wherein the shooter's body engaging portion is either a comb portion or a butt portion of the adjustable gunstock.

4. The adjustable gunstock in accordance with claim 1, wherein the adjustable gunstock includes:

a primary base attached generally horizontally to the stock body, wherein a primary mount engages therewith, and a comb portion is attached to the primary mount; and a secondary base attached generally vertically to the stock body, wherein a secondary mount engages therewith, and a butt portion is attached to the secondary mount.

5. The adjustable gunstock in accordance with claim 1, wherein the first screw post and the second screw post engage a respective clevis, wherein each respective clevis is pivotably connected to the mount by way of a respective pivot pin.

6. The adjustable gunstock in accordance with claim 5, wherein the first screw post and the second screw post are rotatable relative to the respective clevis.

7. The adjustable gunstock in accordance with claim 1, wherein the first slider block and the second slider block are engaged by a respective first cross screw and second cross screw to control sideways movement of the first slider block and the second slider block relative to the base, wherein the first slider block and the second slider block are each mounted on a respective cross slide pin, wherein the respective cross slide pins are parallel with the first cross screw and the second cross screw, whereby rotation of the first cross screw or the second cross screw moves the corresponding first slider block or the second slider block along the respective cross slide pin.

8. The adjustable gunstock in accordance with claim 2, wherein:

the first adjustment member includes a first rack attachable to and extending outwardly from the mount, a first pinion rotatably attachable to the base and configured to engage the first rack, and a first relocation member configured to move the first rack laterally relative to the first pinion; and the second adjustment member includes a second rack attachable to and extending outwardly from the mount, a second pinion rotatably attachable to the base and configured to engage the second rack, and a second relocation member configured to move the second rack laterally relative to the second pinion.

9. The adjustable gunstock in accordance with claim 1, wherein the mount includes an inner mount portion and an outer mount portion when the at least one adjustment member is positioned within the butt of the stock body, such that the inner mount portion is slidably held within or adjoining the outer mount portion, whereby a butt portion attached to or forming a part of the outer mount portion is movable vertically relative to the stock body of the firearm.

10. A method of fitting a firearm for a shooter comprising:

providing the adjustable gunstock in accordance with claim 1;

positioning the firearm such that the mount, or a part attachable thereto engages a shoulder area or cheek region of the shooter;

a. adjusting one or both of the first relocation member and/or the second relocation member to thereby adjust the mount relative to the base in a first direction;

b. adjusting one or both of the first cross screw and/or the second cross screw to thereby adjust the mount relative to the base in a second direction;

wherein the mount is movable both laterally of, and/or away from or towards, the stock body of the firearm; and repeating step a. and b. to provide a suitable gun fit for the shooter.

11. The method in accordance with claim 10 wherein a degree of pitch, a fit against a face of the shooter, a length of pull, a cast-off and/or a fit against the shoulder of the shooter, are adjusted to provide the suitable gun fit for the shooter.

12. The adjustable gunstock in accordance with claim 1, wherein the first cross screw engages a cooperatively threaded aperture extending through the first slider block and the first cross slide pin engages through a hole that extends through the first slider block, wherein the hole is parallel and spaced apart from the threaded aperture; wherein the second cross screw engages a cooperatively threaded aperture extending through the second slider block and the second cross slide pin engages through a hole that extends through the second slider block, wherein the hole extending through the second slider block is parallel and spaced apart from the threaded aperture extending through the second slider block.

* * * * *